US008106862B2

(12) United States Patent
Miyata

(10) Patent No.: US 8,106,862 B2
(45) Date of Patent: Jan. 31, 2012

(54) LIQUID CRYSTAL DISPLAY DEVICE FOR REDUCING INFLUENCE OF VOLTAGE DROP IN TIME-DIVISION DRIVING, METHOD FOR DRIVING THE SAME, LIQUID CRYSTAL TELEVISION HAVING THE SAME AND LIQUID CRYSTAL MONITOR HAVING THE SAME

(75) Inventor: Hidekazu Miyata, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 807 days.

(21) Appl. No.: 11/578,780

(22) PCT Filed: May 17, 2005

(86) PCT No.: PCT/JP2005/009311

§ 371 (c)(1),
(2), (4) Date: Oct. 18, 2006

(87) PCT Pub. No.: WO2005/111981

PCT Pub. Date: Nov. 24, 2005

(65) Prior Publication Data

US 2007/0171163 A1 Jul. 26, 2007

(30) Foreign Application Priority Data

May 19, 2004 (JP) ..... 2004-149637
Nov. 29, 2004 (JP) ..... 2004-344595

(51) Int. Cl.
*G09G 3/36* (2006.01)

(52) U.S. Cl. ..... 345/87; 345/89; 345/96

(58) Field of Classification Search ..... None
See application file for complete search history.

(56) References Cited

U.S. PATENT DOCUMENTS 5,754,156 A * 5/1998 Erhart et al. ..... 345/98
5,818,419 A * 10/1998 Tajima et al. ..... 345/691
6,297,788 B1 * 10/2001 Shigeta et al. ..... 345/63
6,469,684 B1 * 10/2002 Cole ..... 345/58

(Continued)

FOREIGN PATENT DOCUMENTS

JP 2-217894 8/1990

(Continued)

OTHER PUBLICATIONS

JP2003-066920-Machine translation.*
European Search Report.

*Primary Examiner* — Amare Mengistu
*Assistant Examiner* — Antonio Xavier
(74) *Attorney, Agent, or Firm* — Harness, Dickey & Pierce, P.L.C.

(57) ABSTRACT

A device is provided for setting a voltage applied to each of data signal lines so as to correct a voltage, applied to the pixel, which corresponds to a gradation data signal in each of sub-frames of a single frame. As such, voltage drop, caused by a combination of voltages of the gradation data signal in each of the sub-frames, may be partially or even fully compensated. On this account, it is possible to provide a liquid crystal display device which can lessen or even avoid an influence of the voltage drop caused by, for example, gate-drain capacitance of the thin film transistor in case of adopting time-division driving, and/or a method for driving the liquid crystal display device.

8 Claims, 23 Drawing Sheets

U.S. PATENT DOCUMENTS

| | | | | |
|---|---|---|---|---|
| 6,831,620 | B1 | 12/2004 | Nishikubo et al. | |
| 6,937,224 | B1 | 8/2005 | Miyachi | |
| 7,348,953 | B1 * | 3/2008 | Satake | 345/97 |
| 2002/0003520 | A1 * | 1/2002 | Aoki | 345/87 |
| 2002/0030691 | A1 * | 3/2002 | McKnight et al. | 345/602 |
| 2002/0033789 | A1 * | 3/2002 | Miyata et al. | 345/89 |
| 2002/0109659 | A1 | 8/2002 | Hiroki | |
| 2002/0158857 | A1 | 10/2002 | Iisaka | |
| 2002/0163490 | A1 | 11/2002 | Nose | |
| 2003/0058228 | A1 * | 3/2003 | Katoh et al. | 345/204 |
| 2003/0146893 | A1 * | 8/2003 | Sawabe | 345/89 |
| 2003/0227431 | A1 * | 12/2003 | Chung et al. | 345/98 |
| 2004/0048069 | A1 * | 3/2004 | Yamada | 428/411.1 |
| 2004/0057001 | A1 * | 3/2004 | Kim | 349/123 |
| 2005/0099549 | A1 | 5/2005 | Chen et al. | |

FOREIGN PATENT DOCUMENTS

| | | | |
|---|---|---|---|
| JP | 05-068221 | | 3/1993 |
| JP | 2001-060078 | | 3/2001 |
| JP | 2001-100711 | | 4/2001 |
| JP | 2003-066920 | | 3/2003 |
| JP | 2003-66920 | A | 3/2003 |
| TW | 574679 | B | 2/2004 |
| TW | 230370 | B | 4/2005 |

* cited by examiner

FIG. 12 (a) Prior Art
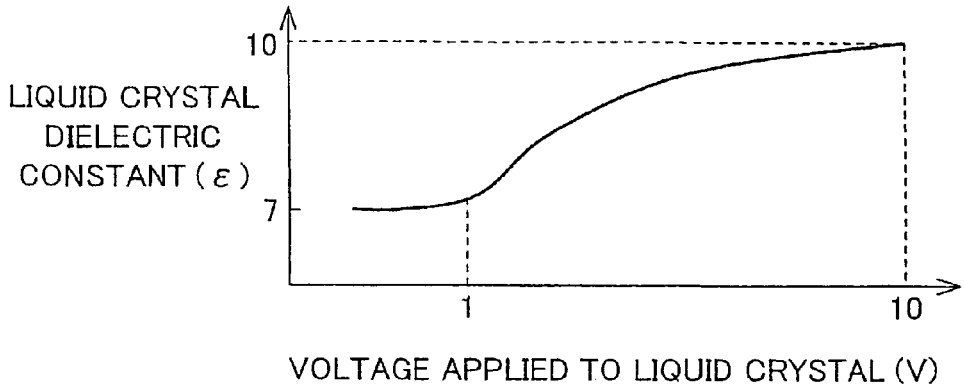
FIG. 12 (b) Prior Art
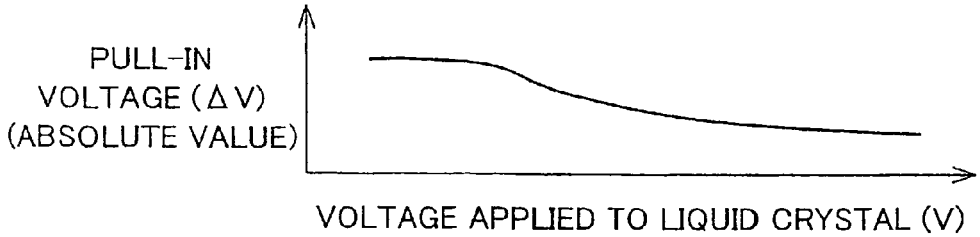

FIG. 14 (a)
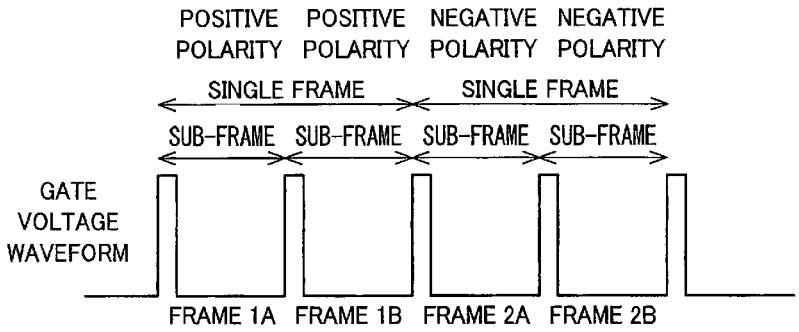
FIG. 14 (b) DISPLAY INPUT DATA: ki (HALFTONE)
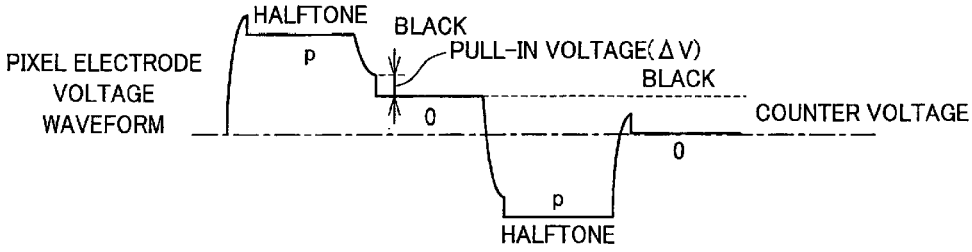
FIG. 14 (c) DISPLAY INPUT DATA: 0 (BLACK)
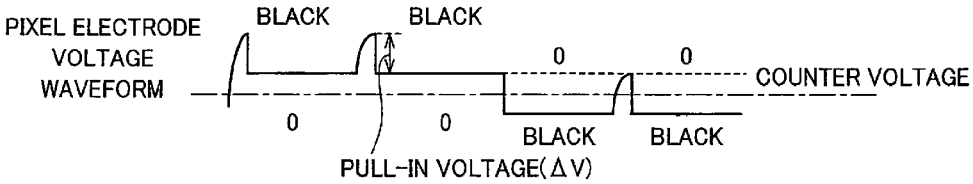

DISPLAY INPUT GRADATION DATA: HALFTONE

CONDITION UNDER WHICH LIQUID CRYSTAL MOLECULES ARE ALIGNED WHEN PULL-IN OCCURS

DISPLAY INPUT GRADATION DATA: BLACK (0)

CONDITION UNDER WHICH LIQUID CRYSTAL MOLECULES ARE ALIGNED WHEN PULL-IN OCCURS

LIQUID CRYSTAL DISPLAY DEVICE FOR REDUCING INFLUENCE OF VOLTAGE DROP IN TIME-DIVISION DRIVING, METHOD FOR DRIVING THE SAME, LIQUID CRYSTAL TELEVISION HAVING THE SAME AND LIQUID CRYSTAL MONITOR HAVING THE SAME

TECHNICAL FIELD

The present invention generally relates to (i) a liquid crystal display device, (ii) a driving method of the liquid crystal display device, (iii) a liquid crystal television having the liquid crystal display device, and/or (iv) a liquid crystal monitor having the liquid crystal display device.

BACKGROUND ART

Explanation of a TFT (Thin Film Transistor) Liquid Crystal Panel

A TFT liquid crystal panel uses a nonluminous element. Generally, a backlight or a reflection plate is provided on a back side of the TFT liquid crystal panel, and the TFT liquid crystal panel applies a voltage to liquid crystal on the basis of luminance of the back light or the like so as to change a transmittance of the liquid crystal, thereby displaying an image. When a voltage corresponding to display gradation data is applied to a pixel of the TFT liquid crystal panel, a transmittance (liquid crystal alignment) of the pixel is maintained until a next voltage is applied, and its gradation luminance continues to be displayed in a single frame.

Generally, data is rewritten at each frame cycle so as to display an image in TV or the like, so that a certain luminance corresponding to the data is kept in the pixel of the TFT liquid crystal panel in a single frame. Unlike a CRT (cathode-ray tube) adopting a display mode referred to as an impulse mode (a mode in which light emission immediately stops), such a TFT liquid crystal panel adopts a mode referred to as a hold mode. In the hold mode, the same display condition is kept during a single frame period in displaying a moving image, so that a deviation occurs between a visual line and the display condition. The deviation between the visual line and the display condition results in a blur image, so that a moving image display property in the hold mode is inferior to that in the impulse mode.

Further, liquid crystal molecules have anisotropy, and a voltage causes alignment of the liquid crystal molecules to vary so that a transmittance varies. Between a case of viewing the panel from a front direction (from a normal direction with respect to a surface of the panel) and a case of viewing the panel from a diagonal direction with respect to the front direction, there is a difference in terms of the transmittance and a voltage property concerning the transmittance. That is, the liquid crystal panel has a viewing angle property corresponding to display gradation luminance.

In a case where many people view an image displayed in a monitor like TV, it is not preferable that a property of the image seems different depending on each viewing angle. In contrast, the CRT is self luminous, so that it is free from such a viewing angle property.

Recently, the TFT liquid crystal panel has been being widely used in TV or the like, and has raised problems such as display quality of a moving image and a viewing angle property of the liquid crystal panel as described above.

In order to attempt to solve such problems, the following techniques have been proposed. For example, Japanese Unexamined Patent Publication No. 60078/2001 (Tokukai 2001-60078)(Publication date: Mar. 6, 2001) proposed a driving method in which: in order to improve a response property (moving image display quality), black was inserted in a single frame so as to improve the moving image quality. Japanese Unexamined Patent Publication No. 68221/1993 (Tokukaihei 5-68221)(Publication date: Mar. 19, 1993) proposed a driving method in which: in order to improve the viewing angle property, two luminances were displayed in a single frame and integrated luminance thereof was used to perform gradation luminance display so as to improve the viewing angle property. According to these techniques, unlike the general hold mode display driving, two or more luminances were displayed in a certain pixel in a single frame when outputting a single gradation luminance.

[Explanation of Pull-in (Voltage Drop) in the TFT Liquid Crystal Panel]

The TFT liquid crystal panel is schematically shown in FIG. 8. As shown in FIG. 8, the TFT liquid crystal panel is structured so that a liquid crystal layer 3 is sandwiched between a TFT glass substrate 1 and a counter glass substrate 2. A counter electrode 4 is provided on one side of the counter glass substrate 2, and a TFT element 6 is provided on each pixel 5 of the TFT glass substrate 1 and a drain of the TFT element 6 is connected to a pixel electrode 7 as shown in FIGS. 9(*a*) and 9(*b*).

On the TFT glass substrate 1, source lines 8 each of which supplies a data voltage to the TFT element 6 are vertically provided and gate lines 9 each of which turns ON the TFT element 6 are horizontally provided. Each of the source lines 8 is connected to a source of the TFT element 6 and each of the gate lines 9 is connected to a gate of the TFT element 6. When a voltage of the gate line 9 has a high value, the TFT element 6 turns ON, so that a voltage of the source line 8 is applied to the pixel electrode 7 positioned on the side of the drain. When a gate voltage is low, the gate turns OFF, so that electric charge of the pixel electrode 7 is kept.

As shown in FIG. 10, there is a capacitance between the gate and the drain of the TFT element 6, and the pixel electrode 7 is coupled to the gate line 9 via a capacitance Cgd. Thus, when the gate of the TFT element 6 turns OFF, the capacitance Cgd causes pull-in of the pixel voltage (causes the pixel voltage to drop) so that $\Delta V = Cgd/(Clc+Ccs+Cgd) \times Vgh$, where Clc represents a capacitance of the liquid crystal, Ccs represents a capacitance of Cs, Cgd represents a drain-gate capacitance of the TFT element 6, and Vgh represents a voltage difference between a gate High and a gate Low.

Thus, as shown in FIG. 11, a voltage applied to the pixel electrode drops to be lower than a writing voltage (a voltage inputted to a data signal line) by $\Delta V$. In both positive and negative polarities, the pixel electrode voltage drops to be lower than each writing voltage by $\Delta V$. In order to compensate the aforementioned voltage drop, a voltage of a data signal line driving circuit (hereinafter, referred to as a source driver) for applying the voltage to the source line is set as follows: A pixel voltage higher by $\Delta V$ than a voltage desired in each polarity is inputted to the pixel electrode in advance, and correction is performed so as to correspond to the voltage drop.

When the correction is not performed, the luminance varies between polarities, so that flicker occurs. This is because: a voltage corresponding to a potential difference between the counter electrode voltage and the pixel electrode voltage is applied to the liquid crystal layer 3, and an absolute value of the voltage applied to the liquid crystal layer 3 varies between the positive polarity and the negative polarity.

Incidentally, a value of the aforementioned liquid crystal capacitance Clc varies according to a condition under which liquid crystal molecules are aligned. In the liquid crystal display element, the condition under which liquid crystal molecules are aligned varies depending on a voltage applied to the liquid crystal, and its transmittance is varied so as to perform gradation luminance display. Thus, the pull-in voltage varies depending on a display gradation.

As a result, as shown in FIGS. 12(*a*) and 12(*b*), increase of a voltage applied to the liquid crystal causes a dielectric constant of the liquid crystal to increase. Thus, the pull-in voltage decreases. Note that, such a relationship depends on a dielectric property of the liquid crystal.

As described, in the TFT liquid crystal panel, the pull-in voltage varies with respect to the voltage applied to the liquid crystal. Thus, in the current hold mode, an output voltage of the source driver for driving the liquid crystal panel is varied so that voltage drop of a pixel electrode writing voltage is partially or even fully compensated in each gradation.

However, the conventional liquid crystal display device may have at least one of the following problems.

That is, in the case of time-division driving (including black insertion driving), that is, in the case where a frame is divided so as to display a certain gradation, as shown in FIG. 13, an output luminance of a pixel in outputting a certain gradation luminance results from repetition of two luminance conditions. In this case, the liquid crystal alignment results from repetition of two conditions.

When a single frame is divided into a former sub-frame and a latter sub-frame, a condition under which liquid crystal molecules are aligned upon applying a latter sub-frame voltage corresponds to a final alignment condition in the former sub-frame. Further, a condition under which liquid crystal molecules are aligned upon applying a former sub-frame voltage corresponds to a final alignment condition in the latter sub-frame.

That is, when a pixel voltage is applied in the latter sub-frame, a pull-in voltage is brought about by the liquid crystal capacitance Clc under the final alignment condition in the former sub-frame. When a pixel voltage is applied in the former sub-frame, a pull-in voltage is brought about by the liquid crystal capacitance Clc under the final alignment condition in the latter sub-frame.

Thus, a pull-in voltage $\Delta V$ caused by the capacitance Cgd is different from a pull-in voltage in the general hold mode driving since the pull-in voltage $\Delta V$ is determined depending on a liquid crystal alignment condition in a sub-frame preceding a sub-frame in applying a voltage. Note that, in an example shown in FIG. 13, black display is performed in the former sub-frame, and gradation display is performed in the latter sub-frame.

In this manner, as to a voltage applied to the pixel of the TFT liquid crystal in time-division driving, a pull-in voltage varies depending on a combination of sub-frames. Thus, the pull-in voltage should be varied according to the combination of the sub-frames and compensate the pull-in voltage in positive and negative polarities.

For example, in case of Tokukai 2001-60078, a condition under which liquid crystal molecules are aligned in applying a signal data voltage is a black display condition. When a black insertion signal voltage is applied, the alignment condition corresponds to a condition of the signal data voltage. Further, in case of Tokukaihei 5-68221, the alignment condition corresponds to a condition of another combination for performing gradation display.

Thus, a correction device/method/etc. can be prepared for canceling the voltage drop of the pull-in voltage caused by the liquid crystal capacitance Clc under the liquid crystal alignment condition. However, neither Tokukai 2001-60078 nor Tokukaihei 5-68221 take the pull-in voltage into consideration. Each of these techniques merely applies the data signal.

In case of the current hold mode display driving, the pull-in voltage caused by the capacitance Cgd at the time of voltage application is corrected so that a pull-in voltage of an output voltage with respect to an input gradation signal value of the source driver of the TFT panel is partially or even fully compensated in each polarity. However, in case of the time-division driving, as described, the pull-in voltage should be varied depending on a combination of sub-frames, so that the current source driver cannot set an output voltage for compensating the pull-in voltage with respect to all the output gradations at the time of time-division driving.

In case where correction for compensating the voltage drop is not performed, a certain voltage is added to the liquid crystal layer. Thus, ions (electric charge) such as impurities in the liquid crystal layer move to an electrode due to a potential difference between the pixel electrodes. An alignment film is applied to an electrode of the liquid crystal panel, and the alignment film is insulative, so that the alignment film is charged with ions (electric charge).

Thus, in the liquid crystal panel under such condition that a direct current voltage component DC remains for a long time, even when no voltage is applied, a voltage remains in its pixel electrode. For example, when a halftone luminance letter which has not been corrected so as to cancel the voltage drop is displayed for a long time in a black gradation luminance corrected so as to cancel the voltage drop, a pixel displaying the letter is charged with electric charge.

As a result, even when display of the letter is stopped after the long time display and entire black display is performed, electric charge remains on the pixel which has displayed the letter, so that the letter slightly remains due to a potential difference caused by the electric charge. Thus, in case where the correction for canceling the voltage drop is not performed, such burning phenomenon occurs.

The aforementioned method for compensating the pull-in voltage at the time of time-division driving has not been established. Thus, the TFT liquid crystal panel still may have problems including at least one of burning and flicker.

DISCLOSURE OF INVENTION

At least one embodiment of the present invention was made with at least one of the foregoing problems in mind. An object of at least one embodiment of the present invention is to provide (i)a liquid crystal display device which may, for example, lessen or even avoid voltage drop caused by a gate-drain capacitance of a thin film transistor in case of adopting time-division driving, (ii) a driving method of the liquid crystal display device, (iii) a liquid crystal television having the liquid crystal display device and/or (iv) a liquid crystal monitor having the liquid crystal display device.

In order to reduce or even solve one of the foregoing problems for example, a liquid crystal display device of at least one embodiment of the present invention is directed toward a liquid crystal display device, causing a thin film transistor to switch each of pixels formed in junctions of a plurality of data signal lines and a plurality of scanning signal lines so as to display an image and time-dividing a single frame into sub-frames so as to perform image gradation display. A liquid crystal display device of at least one embodiment includes an applied voltage setting section for setting a voltage applied to each of the data signal lines so as to correct a voltage, applied to the pixel, which corresponds to a gradation data signal in each of the sub-frames of the single frame. As such, voltage drop, based on a gate-drain capacitance of the thin film transistor, which is caused by a combination of voltages of the gradation data signal in each of the sub-frames, may be improved or even partially or even fully compensated.

In another embodiment, a liquid crystal display device is for carrying out gradation display, via sub-frames of a time-divided image, to each of a plurality of pixels via a respective switching device. The liquid crystal display device includes an applied voltage setting device, adapted to set a voltage to be applied to each respective pixel based at least in part upon a voltage value of previous sub-frame, so as to at least partially compensate for a capacitance induced voltage drop of each respective switching device.

A method of at least one embodiment of the present invention is for driving a liquid crystal display device, to carry out gradation display, via sub-frames of a time-divided image, to each of a plurality of pixels via a respective switching device. The method includes setting a voltage to be applied to each respective pixel based at least in part upon a voltage value of previous sub-frame, so as to at least partially compensate for a capacitance induced voltage drop of each respective switching device.

Further, in order to help or even solve at least one of the foregoing problems, a method of at least one embodiment of the present invention for driving a liquid crystal display device, causes a thin film transistor to switch each of pixels formed in junctions of a plurality of data signal lines and a plurality of scanning signal lines so as to display an image and time-dividing a single frame into sub-frames so as to perform image gradation display. The method of at least one embodiment includes the step of setting a voltage applied to each of the data signal lines so as to correct a voltage, applied to the pixel, which corresponds to a gradation data signal in each of the sub-frames of the single frame. As such, voltage drop, based on a gate-drain capacitance of the thin film transistor, which is caused by a combination of voltages of the gradation data signal in each of the sub-frames, may be improved or even partially or even fully compensated.

That is, in case of applying a voltage corresponding to a gradation data signal to each pixel via the data signal line in each sub-frame of a single frame, a voltage drop occurs, based on a gate-drain capacitance of the thin film transistor, which corresponds to a voltage of the gradation data signal.

In at least one embodiment of the present invention, the applied voltage setting section sets the voltage applied to the data signal line so as to improve, partially compensate or even fully compensate for the voltage drop corresponding to the voltage of the gradation data signal.

As a result, it is possible to provide (i) a liquid crystal display device which can lessen or even avoid an influence of the voltage drop caused by the gate-drain capacitance of the thin film transistor in case of adopting time-division driving and/or (ii) a driving method of the liquid crystal. display device.

Further, in order to improve or even solve at least one of the foregoing problems, a liquid crystal display device of at least one embodiment of the present invention may include a liquid crystal display device varying a polarity based on a potential difference between an output voltage outputted to a pixel electrode and a voltage applied to a counter electrode in each frame, which time-divides a frame period into two or more sub-frame periods. This may be done so as to perform luminance display so that minimum luminance display (to a minimum or relatively minimum value, or to a value smaller than a first value) or maximum luminance display (to a maximum value or relatively maximum value, or a value larger than a second value) is performed in at least one sub-frame period of the two or more sub-frame periods.

The liquid crystal display device of at least one embodiment may include a second voltage generation section which includes both or one of: a first luminance plural-output section for outputting a plurality of output voltages, each including a similar potential difference between the pixel electrode and the counter electrode, to the pixel electrode so as to perform relatively minimum luminance display to a value smaller than a first value; and a second luminance plural-output section for outputting a plurality of output voltages, each including a similar potential difference between the pixel electrode and the counter electrode, to the pixel electrode so as to perform relatively maximum luminance display to a value larger than a second value.

In at least one embodiment, a liquid crystal display device is adapted to vary a polarity based on a potential difference between an output voltage outputted to a pixel electrode and a voltage applied to a counter electrode in each frame period of an image, time-divided into two or more sub-frame periods so as to perform luminance display so that at least one of relative minimum luminance display, minimum luminance display, relative maximum luminance display and maximum luminance display is performed in at least one sub-frame period. The liquid crystal display device includes a voltage generation device. The voltage generation device includes one or more of a first luminance plural-output device, adapted to output a plurality of output voltages, each including a similar potential difference between the pixel electrode and the counter electrode, to the pixel electrode so as to perform at least one of the relative minimum luminance display and minimum luminance display; and a second luminance plural-output device, adapted to output a plurality of output voltages, each including a similar potential difference between the pixel electrode and the counter electrode, to the pixel electrode so as to perform at least one of the relative maximum luminance display and the maximum luminance display.

Further, in order to improve or even solve at least one of the foregoing problems, a method of at least one embodiment of the present invention for driving a liquid crystal display device may include varying a polarity based on a potential difference between an output voltage outputted to a pixel electrode and a voltage applied to a counter electrode in each frame, which time-divides a frame period into two or more sub-frame periods so as to perform luminance display so that relatively minimum luminance display to a value smaller than a first value or relatively maximum luminance display to a value larger than a second value is performed in at least one sub-frame period of the two or more sub-frame periods.

The method of at least one embodiment may include both of or one of the steps of: outputting a plurality of output voltages, each including a similar potential difference between the pixel electrode and the counter electrode, to the pixel electrode so as to perform relatively minimum luminance display to a value smaller than a first value; and outputting a plurality of output voltages, each including a similar potential difference between the pixel electrode and the counter electrode, to the pixel electrode so as to perform relatively maximum luminance display to a value larger than a second value.

In at least one embodiment, a method is for driving a liquid crystal display device, wherein a polarity is varied based on a potential difference between an output voltage outputted to a pixel electrode and a voltage applied to a counter electrode in each frame period of an image, time-divided into two. or more sub-frame periods, so as to perform luminance display so that at least one of relative minimum luminance display, minimum luminance display, relative maximum luminance display and maximum luminance display is performed in at least one sub-frame period. The method includes outputting a plurality of first output voltages, each including a similar potential difference between the pixel electrode and the counter electrode, to the pixel electrode so as to perform at least one of the relative minimum luminance display and the minimum luminance display; and outputting a plurality of second output voltages, each including a similar potential difference between the pixel electrode and the counter electrode, to the pixel electrode so as to perform the relative maximum luminance display and the maximum luminance display.

According to at least one embodiment of the invention, the liquid crystal display device may include the second voltage generation section which includes both or one of: the first luminance plural-output section for outputting a plurality of output voltages, each including a similar potential difference between the pixel electrode and the counter electrode, to the pixel electrode so as to perform the relatively minimum luminance display to a value smaller than a first value; and the second luminance plural-output section for outputting a plurality of output voltages, each including a similar potential difference between the pixel electrode and the counter electrode, to the pixel electrode so as to perform the relatively maximum luminance display to a value larger than a second value.

Thus, a relatively minimum luminance (relatively black) output voltage or a relatively maximum luminance (relatively white) output voltage which corresponds to an output voltage in the other sub-frame is selected from minimum or relatively minimum luminance voltages or maximum or relatively maximum luminance voltages, so that it is possible to compensate polarity deviation.

In at least one embodiment, a liquid crystal display device is for carrying out gradation display, via sub-frames of a time-divided image, to each of a plurality of pixels via a respective switching device. The liquid crystal display device includes means setting a voltage to be applied to each respective pixel based at least in part upon a voltage value of previous sub-frame, so as to at least partially compensate for a capacitance induced voltage drop of each respective switching device; and means for applying the voltage.

In at least one embodiment, a method is for driving a liquid crystal display to carry out gradation display for each of a plurality of pixels. The method includes time-dividing an image into a plurality of sub-frames; setting a compensation voltage for each respective pixel based at least in part upon a voltage value of previous sub-frame; and applying the set voltage to each respective pixel.

In at least one embodiment, a method is for driving a liquid crystal display to carry out gradation display of an image for each of a plurality of pixels, each frame of the image being time-divided into a plurality of sub-frames. The method includes setting a compensation voltage for each respective pixel based at least in part upon a voltage value of a previous sub-frame; and applying the set voltage to each respective pixel.

In at least one embodiment, a liquid crystal display device is for carrying out gradation display for each of a plurality of pixels, each frame of the image being time-divided into a plurality of sub-frames. The display device includes a controller, adapted to set a compensation voltage for each respective pixel based at least in part upon a voltage value of a previous sub-frame; and a driving circuit, adapted to apply the set voltage to each respective pixel.

In at least one embodiment, a liquid crystal display device is for carrying out gradation display for each of a plurality of pixels, each frame of the image being time-divided into a plurality of sub-frames. The display device includes means for setting a compensation voltage for each respective pixel based at least in part upon a voltage value of a previous sub-frame; and means for applying the set voltage to each respective pixel.

Further, in order to improve or even solve at least one of the foregoing problems, a liquid crystal television of at least one embodiment of the present invention may include: the liquid crystal display device of at least one aforementioned embodiment; and a tuner section, serving as a video signal source of the liquid crystal display device, which selects a channel of a television broadcasting signal and outputs a television video signal of the channel, that has been selected, as a display signal.

According to at least one aforementioned embodiment of the invention, it is possible to provide a liquid crystal television which includes at least one of (i) a liquid crystal display device which can lessen or even avoid an influence of the voltage drop caused by the gate-drain capacitance of the thin film transistor in case of adopting time-division driving and/or (ii) a driving method of the liquid crystal display device.

Further, in order to improve or even solve at least one of the foregoing problems, a liquid crystal monitor of at least one embodiment of the present invention may include: at least one aforementioned embodiment of the liquid crystal display device; and a monitor signal processing section, serving as a video signal source of the liquid crystal display device, which processes a monitor signal that should be displayed in the liquid crystal display device and outputs the monitor signal, that has been processed, as a video signal.

According to at least one embodiment of the foregoing invention, it is possible to provide a liquid crystal monitor which includes at least one of (i) a liquid crystal display device which can lessen or even avoid an influence of the voltage drop caused by the gate-drain capacitance of the thin film transistor in case of adopting time-division driving and/or (ii) a driving method of the liquid crystal display device.

For a fuller understanding of the nature and advantages of various aspects of the invention, reference should be made to the ensuing detailed description of example embodiments, taken in conjunction with the accompanying drawings.

BRIEF DESCRIPTION OF DRAWINGS

FIG. 1(*b*) is a block diagram showing one embodiment of a depiction of LCD controller 14 of FIG. 1 (*a*).

FIG. 1(*c*) is an example of operation of the frame memory of FIG. 1(*b*).

FIG. 3(*b*) is a waveform chart showing a waveform of a halftone display voltage applied to the pixel of the liquid crystal display device at the time of time-division driving.

FIG. 3(*c*) is a waveform chart showing a waveform of a black display voltage applied to the pixel of the liquid crystal display device at the time of time-division driving.

FIG. 4(*b*) is a waveform chart showing an output luminance of a modified display panel of the liquid crystal display device.

FIG. 5(*b*) is a block diagram showing an arrangement of a liquid crystal monitor provided with the liquid crystal display device.

FIG. 6(*b*), showing another embodiment of the present invention, illustrates how the source driver divides an output resistance in a negative polarity.

FIG. 9(*b*) is a schematic showing an arrangement of a TFT element provided on each of the pixels.

FIG. 12(*a*) is a graph showing a relationship between a voltage applied to liquid crystal and a liquid crystal dielectric constant.

FIG. 12(*b*) is a graph showing a relationship between the voltage applied to liquid crystal and the pull-in voltage.

FIG. 14(*a*) is a waveform chart showing a gate voltage applied to the pixel at the time of time-division driving in the liquid crystal display device.

FIG. 14(*b*) is a waveform chart showing a halftone display voltage applied to the pixel at the time of time-division driving in the liquid crystal display device.

FIG. 14(*c*) is a waveform chart showing a black display voltage applied to the pixel at the time of time-division driving in the liquid crystal display device.

FIG. 15(*b*) is a schematic showing a relationship between a writing voltage and a gradation.

FIG. 15(*c*) is a schematic showing a relationship between a voltage applied to liquid crystal and a gradation.

FIG. 16(*b*) illustrates a relationship between a waveform and a liquid crystal alignment condition in case where display input gradation data is black at the time of divisional display.

FIG. 17(*b*) is a schematic showing a frame-division output ladder resistor in a negative polarity of the source driver.

BEST MODE FOR CARRYING OUT THE INVENTION

Embodiment 1

One embodiment of the present invention is described below with reference to FIGS. 1 to 5 and FIGS. 8 to 12.

Figure 8:
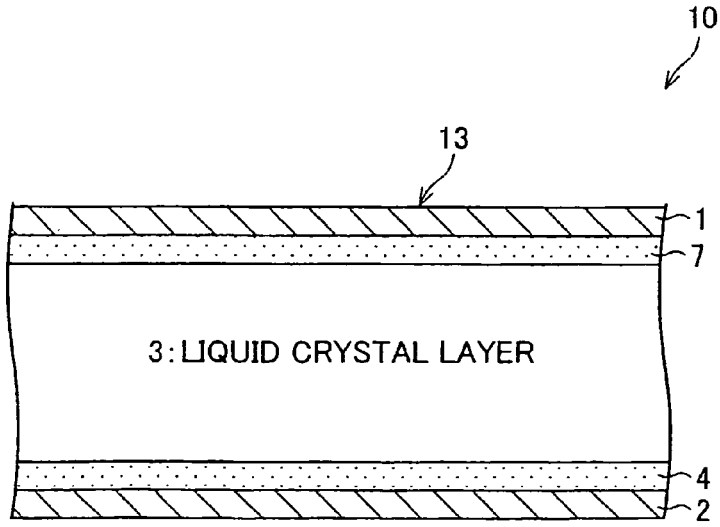
F I G. 8 Prior Art
FIG. 8 is a cross sectional view showing an arrangement of a display panel of the liquid crystal display device.
Figure 9:
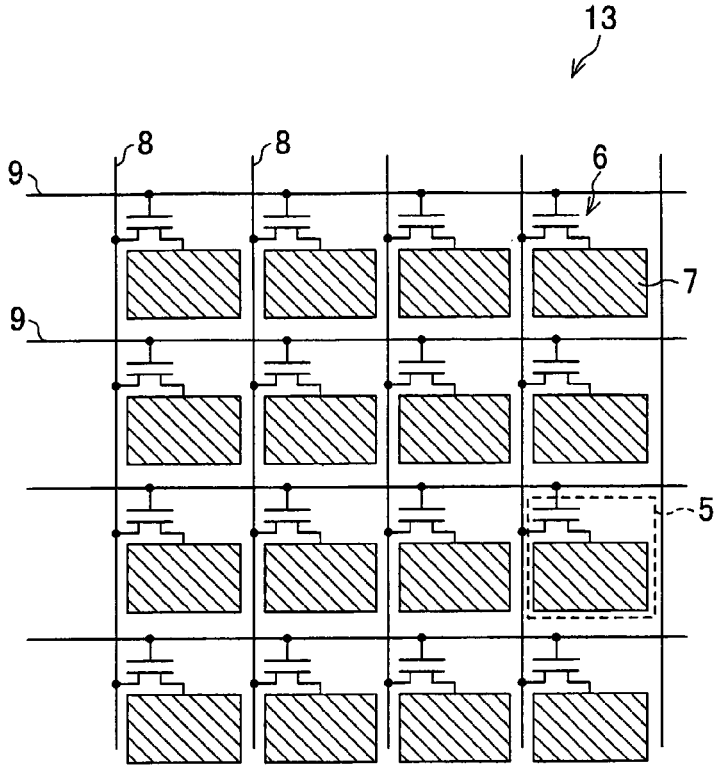
FIG. 9(*a*) is a plan view showing an arrangement of pixels in the display panel of the liquid crystal display device.
Figure 9:
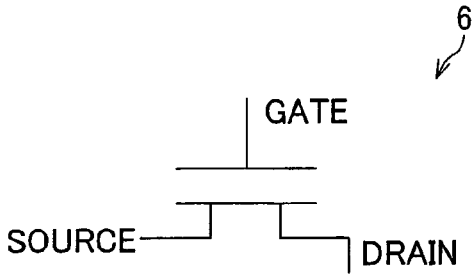

As shown in FIG. 8, a display panel 13 of a liquid crystal display device 10 of an example embodiment has a sandwich structure in which a liquid crystal layer 3 is provided between a TFT (thin film transistor) glass substrate 1 and a counter glass substrate 2. A counter electrode 4 is provided on an entire surface of the counter glass substrate 2, and a TFT element 6 is provided on each pixel 5 in the TFT glass substrate 1 as shown in FIGS. 9(*a*) and 9(*b*), and a drain of the TFT element 6 is connected to a pixel electrode 7.

On the TFT glass substrate 1, source lines 8 serving as data signal lines each of which supplies a data voltage to the TFT element 6 are vertically provided, and gate lines 9 serving as scanning signal lines each of which turns ON the TFT element 6 are horizontally provided. Each of the source lines 8 is connected to a source of the TFT element 6, and each of the gate lines 9 is connected to a gate of the TFT element 6. When a voltage of the gate line 9 has a high value, the TFT element 6 turns ON, so that a voltage of the source line 8 is applied to the pixel electrode 7 positioned on the side of the drain. When a gate voltage is low, the gate turns OFF, so that electric charge of the pixel electrode 7 is kept.

Figure 10:
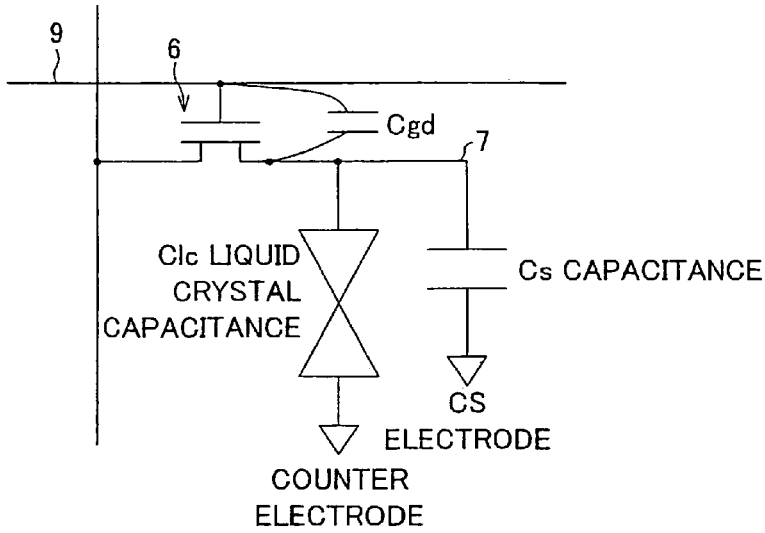
FIG. 10 Prior Art
FIG. 10 is a plan view showing a gate-drain capacitance in the pixel.

As shown in FIG. 10, the pixel electrode 7 has a capacitance between the gate and the drain of the TFT element 6, and is connected to the gate line 9 via a capacitance Cgd. Thus, when the gate of the TFT element 6 turns OFF, the capacitance Cgd causes a pixel voltage to have such a pull-in voltage that $$\Delta V = Cgd/(Clc+Ccs+Cgd)\times Vgh.$$

Here, Clc represents a liquid crystal capacitance, Ccs represents a capacitance of Cs, Cgd represents a drain-gate capacitance of the TFT element 6, and Vgh represents a voltage difference between gate High and gate Low.

Figure 11:
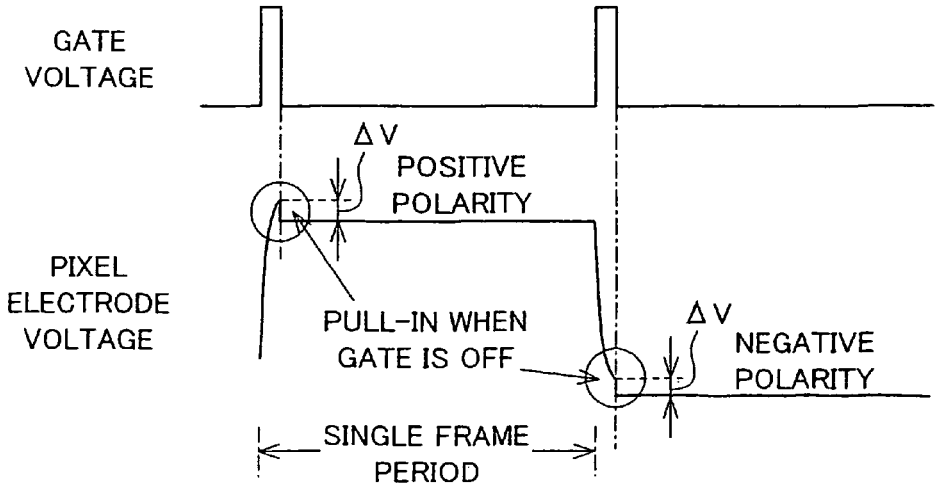
FIG. 11 Prior Art
FIG. 11 is a waveform chart showing a pull-in voltage (voltage drop) caused by the gate-drain capacitance in the pixel.
Figure 13:
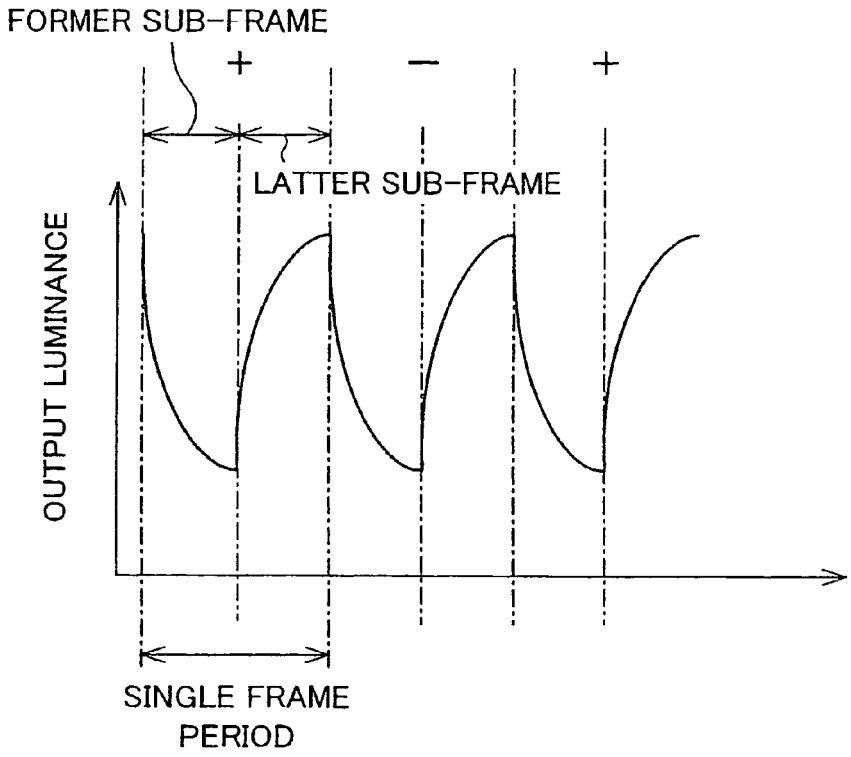
FIG. 13 Prior Art
FIG. 13 is a waveform chart showing an output luminance in outputting a certain gradation at the time of time-division display.

Thus, as shown in FIG. 11, a voltage applied from the source line drops by ΔV. A pixel voltage whose polarity is positive or negative is lower than a voltage applied to the source line with a difference of ΔV. Thus, a source driver output voltage is set in advance to be higher by ΔV.

The liquid crystal capacitance Clc in the foregoing equation has a value which varies depending on an alignment condition of liquid crystal. That is, generally, intensity of the pull-in voltage greatly varies depending on a display gradation at the time of hold mode display driving. In this case, a relationship between a voltage applied to the liquid crystal and a liquid crystal dielectric constant and a relationship between the voltage applied to the liquid crystal and the pull-in voltage are as illustrated in FIGS. 12(*a*) and 12(*b*). Note that, these relationships are greatly influenced by a dielectric property of the liquid crystal.

In the display panel 13 using the TFT element 6, the pull-in voltage varies with respect to the applied voltage. Thus, generally, in driving a liquid crystal panel in the hold mode, a voltage for partially or even fully compensating a pull-in voltage is added to a writing voltage, and the compensation voltage is varied for each gradation. That is, a voltage obtained by adding a voltage for partially or even fully compensating a pull-in voltage is applied from the source driver to the panel pixel as a writing voltage.

Incidentally, in the liquid crystal display device 10 of an example embodiment, to improve a response (moving image display quality) property and improve an image quality such as a viewing angle property, black may be inserted in a single frame for higher moving image quality, or two luminances may be displayed in a single frame so that an integrated luminance thereof is used to perform gradation display for a better viewing angle property. In case of these techniques, unlike general hold mode display driving, two or more luminances in a single frame may be displayed in outputting a single gradation luminance.

In more detail, the liquid crystal display device 10 of an example embodiment performs normally black mode driving, and a frame is equally divided into two sub-frames. Further, the liquid crystal display device 10 performs time-division driving (including black insertion) so that output luminances in the sub-frames are the same in outputting the black luminance.

Note that, in an example embodiment, the liquid crystal display device 10 performs the normally black mode driving. However, the driving is not limited to this. The liquid crystal display device 10 may perform normally white mode driving. Further, a frame is divided into two sub-frames, but the frame division is not limited to this. A frame can be divided into plural sub-frames, including more than two sub-frames. For example, a frame may be divided into three or more sub-frames. Further, it is not necessary to equally divide a frame.

In such time-division driving, a frame is divided into sub-frames, and a luminance is outputted in each sub-frame, and an integrated luminance of all the luminances in a single frame is an output luminance. Thus, as shown in FIG. 14(*a*), a voltage is applied from the source line to the pixel electrode 7 twice in a single frame period.

Figure 15:
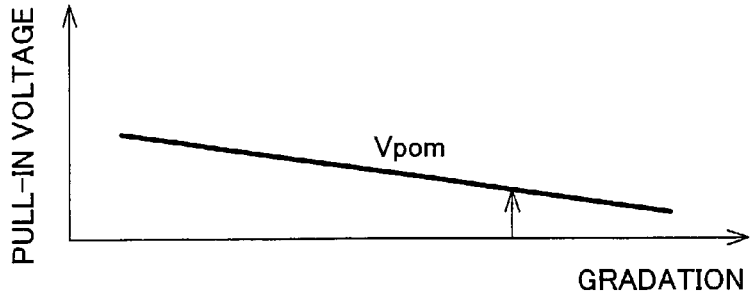
FIG. 15(*a*) is a schematic showing a relationship between a pull-in voltage and a gradation.
Figure 15:
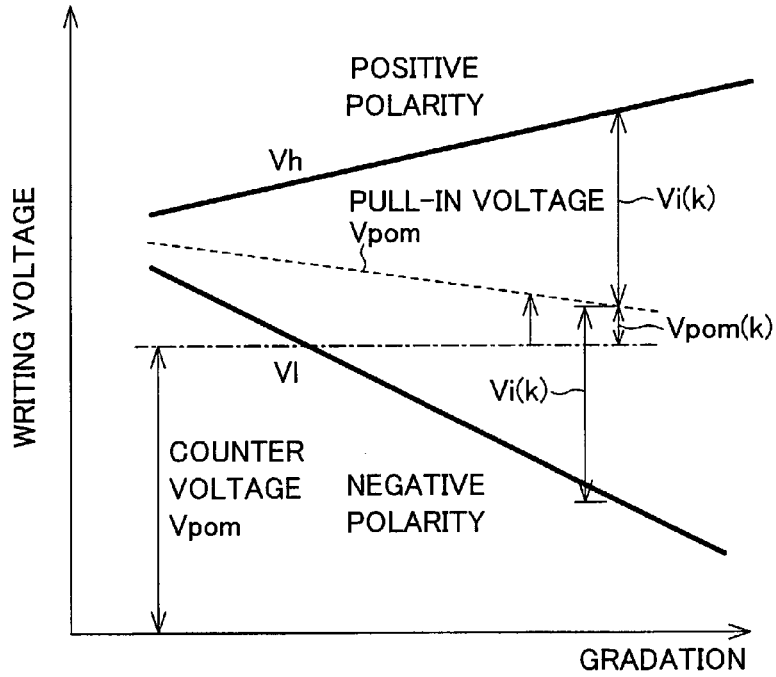
Figure 15:
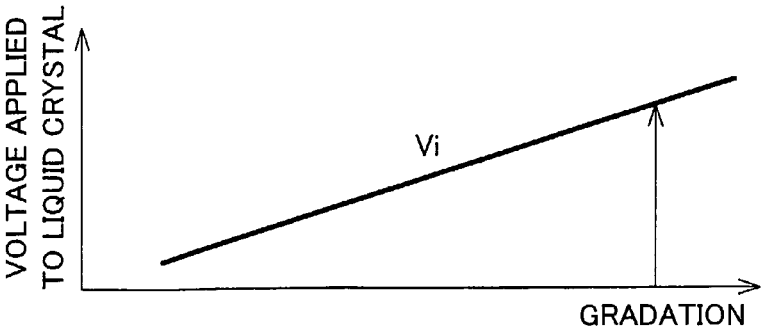

Generally, at the time of hold mode display, in case of displaying a certain gradation in the display panel 13, a relationship between intensity of an input signal gradation to the source driver 11 and a pull-in voltage is shown in FIG. 15(*a*); a relationship between the intensity of the input signal gradation to the source driver 11 and a writing voltage is shown in FIG. 15(*b*; a relationship between the intensity of the input signal gradation to the source driver 11 and a voltage applied to the liquid crystal is shown in FIG. 15(*c*). Note that, in these figures, for convenience in description, a pull-in voltage Vpom with respect to a gradation, a writing voltage (positive polarity: Vh, negative polarity: Vl), and a voltage (Vi) applied to the liquid crystal are in proportion to the input gradation. Thus, these values are different from actual values.

Generally, a relationship among the pull-in voltage Vpom, the writing voltage (positive polarity: Vh, negative polarity: Vl), and the voltage (Vi) applied to the liquid crystal is set in advance on the basis of a source driver reference voltage so that $$\text{positive polarity: } Vh(k)=V\text{com}+V\text{pom}(k)+Vi(k)$$

$$\text{negative polarity: } Vl(k)=V\text{com}+V\text{pom}(k)-Vi(k)$$

where a source driver input gradation is k. Here, a counter voltage Vcom is indicated by a voltage value of the counter electrode 4, and is a constant value.

When these values are set in this manner, a medium value between the writing voltage Vh(k) and the writing voltage Vl(k) is [counter voltage Vcom+pull-in voltage Vpom (k)]. That is, (Vh(k)+Vl(k))/2=Vcom+Vpom (k).

Generally, when a display input signal gradation value is ki in the hold mode display, a driver input signal gradation value inputted to the source driver described later is ki. An output voltage of the source driver 11 in this case is a value set in advance with respect to the gradation value ki, that is, Vh(ki) is outputted when the polarity is positive, and Vl(ki) is outputted when the polarity is negative. Thus, the following equations hold.

$$\text{positive polarity: } Vh(ki)=V\text{com}+V\text{pom}(ki)+Vi(ki)$$

$$\text{negative polarity: } Vl(ki)=V\text{com}+V\text{pom}(ki)-Vi(ki)$$

Thus, the pixel voltages Vhd and Vld are as follows.

$$\text{positive polarity: } Vhd(ki)=Vh(ki)-V\text{com}(ki)=V\text{com}+Vi(ki)$$

$$\text{negative polarity: } Vld(ki)=Vl(ki)-V\text{com}(ki)=V\text{com}-Vi(ki)$$

In the positive polarity, a voltage of Vi(ki) is applied to the liquid crystal on the basis of the counter voltage of the counter electrode 4. In the negative polarity, a voltage of −Vi(ki) is applied to the liquid crystal on the basis of the counter voltage of the counter electrode 4.

Thus, a potential difference between the pixel electrode voltage in the positive polarity and the counter voltage Vcom and a potential difference between the pixel electrode voltage in the negative polarity and the counter voltage are absolutely the same with polarities different from each other (positive and negative). That is, a direct current voltage component DC of a voltage applied to the liquid crystal is 0V. The condition under which the direct current voltage component DC added to the liquid crystal is 0, refers to a condition under which a value of an applied voltage obtained by averaging a voltage added to the liquid crystal in the positive polarity and a voltage added to the liquid crystal in the negative polarity is 0.

At the time of the time-division driving of an example embodiment, for example, in case of the time-division driving for equally dividing a frame period as shown in FIGS. 14(*a*) and 14(*b*), a halftone display input signal gradation value ki is converted into a former sub-frame driver input signal gradation value p and into a latter sub-frame driver input signal gradation value k, and the gradation data is inputted to the source driver 11. Thus, with respect to the display input signal gradation value ki, a driver. output voltage at the time of the time-division driving is as follows in the former sub-frame.

$$\text{positive polarity: } Vh(p)=V\text{com}+V\text{pom}(p)+Vi(p)$$

$$\text{negative polarity: } Vl(p)=V\text{com}+V\text{pom}(p)-Vi(p)$$

In the latter sub-frame, the driver output voltage is as follows.

positive polarity: $Vh(k)=V\text{com}+V\text{pom}(k)+V(k)$ negative polarity: $Vl(k)=V\text{com}+V\text{pom}(k)-V(k)$ Thus, as shown in FIGS. 14(*a*) and 14(*c*), in case where the display input signal gradation value ki is 0, p=k=0, so that a voltage applied to the pixel is as follows in the former sub-frame.

positive polarity: $Vh(0)=V\text{com}+V\text{pom}(0)+Vi(0)$ negative polarity: $Vl(0)=V\text{com}+V\text{pom}(0)-Vi(0)$ Also in the latter sub-frame, the voltage is as follows.

positive polarity: $Vh(0)=V\text{com}+V\text{pom}(0)+Vi(0)$ negative polarity: $Vl(0)=V\text{com}+V\text{pom}(0)-Vi(0)$ This results in a pixel electrode waveform shown in FIG. 14(*c*).

Next, let us consider a case where input signals to the source driver 11 are different from each other in one sub-frame and the other sub-frame. For example, as shown in FIG. 14(*b*), when the input signal is halftone and an output in the latter sub-frame is black, the input gradation signal ki is used as a source driver input signal gradation value p in the former sub-frame and as a source driver input signal gradation value 0 in the latter sub-frame so that the gradation data is converted and inputted to the source driver 11. A voltage applied to the pixel electrode 7 is as follows in the former sub-frame.

positive polarity: $Vh(p)=V\text{com}+V\text{pom}(p)+Vi(p)$ negative polarity: $Vl(p)=V\text{com}+V\text{pom}(p)-Vi(p)$ Also in the latter sub-frame, the voltage is as follows.

positive polarity: $Vh(0)=V\text{com}+V\text{pom}(0)+Vi(0)$ negative polarity: $Vl(0)=V\text{com}+V\text{pom}(0)-Vi(0)$ A voltage of the pixel electrode 7 after the pull-in is determined in accordance with the applied voltage and the pull-in voltage ΔV. The pull-in voltage ΔV is determined depending on the liquid crystal condition. Thus, in case where the liquid crystal condition is varied by the time-division driving, the pull-in voltage ΔV is not Vpom determined depending on a source driver input signal gradation unlike the hold mode driving.

That is, as described, the pull-in voltage ΔV is as follows.

$$\Delta V=Cgd/(Clc+Ccs+Cgd)\times Vgh$$

Here, Cgd represents a gate-drain capacitance of the TFT element 6, Clc represents a liquid crystal capacitance, Ccs represents a Cs capacitance, and Vgh represents a voltage difference (a potential difference when the gate is OFF) between gate High and gate Low.

ΔV is determined on the basis of these values. Among them, the liquid crystal capacitance Clc is a value which varies depending on the liquid crystal alignment condition, and values other than this are constant. Thus, the pull-in voltage ΔV is determined depending on the liquid crystal condition at the time of voltage application.

Figure 16:
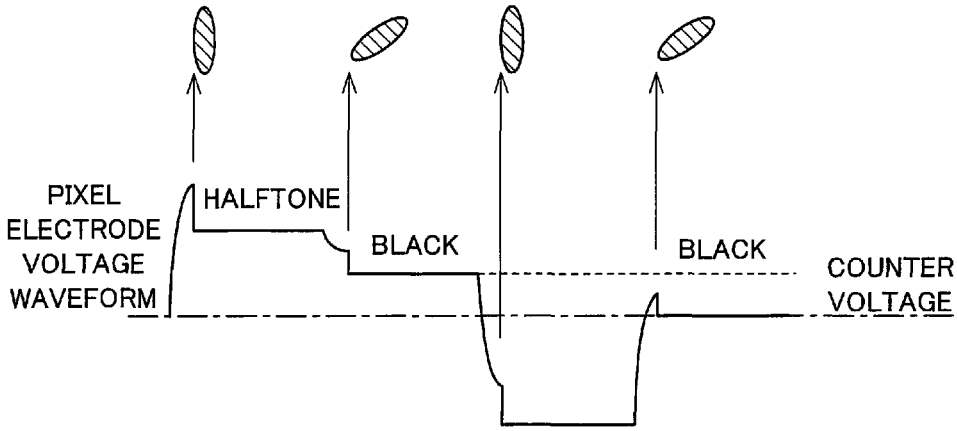
FIG. 16(*a*) illustrates a relationship between a waveform and a liquid crystal alignment condition in case where display input gradation data is halftone at the time of divisional display.
Figure 16:
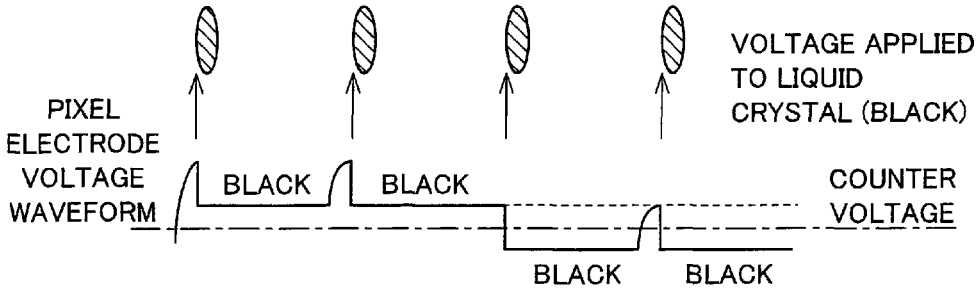

In terms of the liquid crystal condition in case of voltages applied to the pixel that are shown in FIGS. 14(*a*) to 14(*c*), the liquid crystal alignment condition is as shown in FIGS. 16(*a*) and 16(*b*).

That is, as shown in FIG. 16(*a*), when the display input signal gradation value is black (0), the liquid crystal alignment condition does not vary, so that the pull-in voltage ΔV is the same as the pull-in voltage of the source driver input gradation value (also this is 0) in the sub-frame so that $$\Delta V=V\text{pom}(0).$$

While, as shown in FIG. 16(*a*), in case where the display input data is halftone, the liquid crystal condition in applying a voltage corresponding to the source driver input signal gradation value to the pixel is determined depending on the alignment condition after the liquid crystal has responded in the former sub-frame. That is, the liquid crystal condition is determined depending not on a source driver input signal gradation value at the time of voltage application but on a source driver input signal gradation value in a boundary between sub-frames.

Thus, at the time of input in the former sub-frame, the pull-in voltage ΔV of the source driver input signal gradation value p is as follows.

$$\Delta V=V\text{pom}(0)$$

At the time of input in the latter sub-frame, the source driver input signal gradation value is 0, and the pull-in voltage ΔV is as follows.

$$\Delta V=V\text{pom}(p)$$

Thus, a value of the pull-in voltage becomes a value which depends on the source driver input signal gradation value in the other sub-frame of the combination of sub-frames.

As described above, in the former sub-frame when the display input gradation value is ki, in the latter sub-frame when the source driver input signal gradation value is p, and when the source driver input signal gradation value is 0, a voltage applied to the pixel is as follows.

In the former sub-frame, positive polarity: $Vh(p)=V\text{com}+V\text{pom}(p)+Vi(p)$ negative polarity: $Vl(p)=V\text{com}+V\text{pom}(p)-Vi(p)$.

In the latter sub-frame, positive polarity: $Vh(0)=V\text{com}+V\text{pom}(0)+Vi(0)$ negative polarity: $Vl(0)=V\text{com}+V\text{pom}(0)-Vi(0)$.

In the former sub-frame, positive and negative polarities of the pull-in pixel voltage are as follows.

positive polarity: $Vhd(p)=Vh(p)-V\text{pom}(0)=V\text{com}+Vi(p)+(V\text{pom}(p)-V\text{pom}(0))$ negative polarity: $Vld(p)=Vl(p)-V\text{pom}(0)=V\text{com}-Vi(p)+(V\text{pom}(p)-V\text{pom}(0))$ In the latter sub-frame, the positive and negative polarities are follows.

positive polarity: $Vhd(p)=Vh(0)-V\text{pom}(p)=V\text{com}+Vi(p)+(V\text{pom}(0)-V\text{pom}(p))$ negative polarity: $Vld(0)=Vl(0)-V\text{pom}(p)=V\text{com}-Vi(p)+(V\text{pom}(0)-V\text{pom}(p))$ Thus, in the former sub-frame, an absolute value of a voltage applied to liquid crystal becomes higher in the positive polarity so that [Vcom(p)−Vpom(0)], and becomes lower in the negative polarity. Further, in the latter sub-frame, an absolute value of a voltage applied to liquid crystal becomes higher in the positive polarity so that [Vpom(0)−Vpom(p)], and becomes lower in the negative polarity. Here, a direct current voltage component DC of a voltage applied to liquid crystal is 0 in all the former and latter sub-frame periods (two frame periods) in positive and negative polarities.

However, an absolute value of a voltage applied to liquid crystal in the positive polarity in the sub-frame is different from an absolute value of a voltage applied to liquid crystal in the negative polarity in the sub-frame, and a luminous difference occurs between polarities of the sub-frame, so that flicker occurs.

Further, in case where the liquid crystal completely responds, an absolute value of a voltage applied to liquid crystal in the positive polarity in the sub-frame is the same as an absolute value of a voltage applied to liquid crystal in the negative polarity in the sub-frame during two frame periods as described above. However, the liquid crystal should finish responding within the sub-frame (0→100%) in transition of all the gradations. In case where the liquid crystal cannot finish responding in this manner, the absolute value of the voltage applied to liquid crystal in the positive polarity and the absolute value of the voltage applied to liquid crystal in the negative polarity are different from each other. Thus, as described above, burning occurs.

In order to lessen or even solve such a problem, in an example embodiment, data conversion is carried out in the positive and negative polarities so as to correspond to a combination of sub-frames, and a voltage obtained by partially or even fully compensating a pull-in voltage is applied to the panel pixel.

[Sub-Frame+Positive-Polarity/Negative-Polarity Data Conversion]

Specifically, when a data input signal gradation value for displaying an image at the time of time-division driving is ki, and an input signal gradation in the former sub-frame is p, and an input gradation signal in the latter sub-frame is k, the source driver voltage output should be set as follows in order that a direct current voltage component DC in the latter sub-frame is 0.

$$\text{positive polarity: } Vh(k)=V\text{com}+V\text{pom}(p)+Vi(k)$$

$$\text{negative polarity: } Vl(k)=V\text{com}+V\text{pom}(p)-Vi(k)$$

Thus, the output voltage relates not only to the source driver input signal gradation value but also to a source driver input signal gradation value in the other sub-frame of the combination. That is, the output voltage relates to p when the source driver input signal gradation value is k, but only a single output value cannot be set in each of positive and negative polarities as to the input gradation value k in accordance with the current source driver output setting. That is, the following condition occurs.

Driver Input Driver Output

K, polarity→Vh(k, positive polarity), Vl(k, negative polarity)

Thus, the source driver input signal gradation value k is converted, and a positive polarity of the source driver signal gradation value is converted into k+ and a negative polarity of the source driver signal gradation value is converted into k− so that the driver output is a desired voltage, and then the converted values are inputted to the source driver 11. k+ and k− in this case are obtained in accordance with the following equation.

$$\{Vh(k+)+Vl(k-)\}/2=V\text{pom}(p)+Vcom$$

$$\{Vh(k+)-Vl(k-)\}/2=Vi(k)$$

Further, in case where response of the liquid crystal is slow, the desired liquid crystal alignment condition is not realized in the sub-frame, so that the condition does not correspond to the calculated k+ and k−. In case of the liquid crystal whose response is slow in this manner (the liquid crystal which does not finish responding in the sub-frame), values of k+ and k− are determined in accordance with optical measurement.

Also the source driver input gradation data in the former sub-frame is converted likewise.

Figure 2:
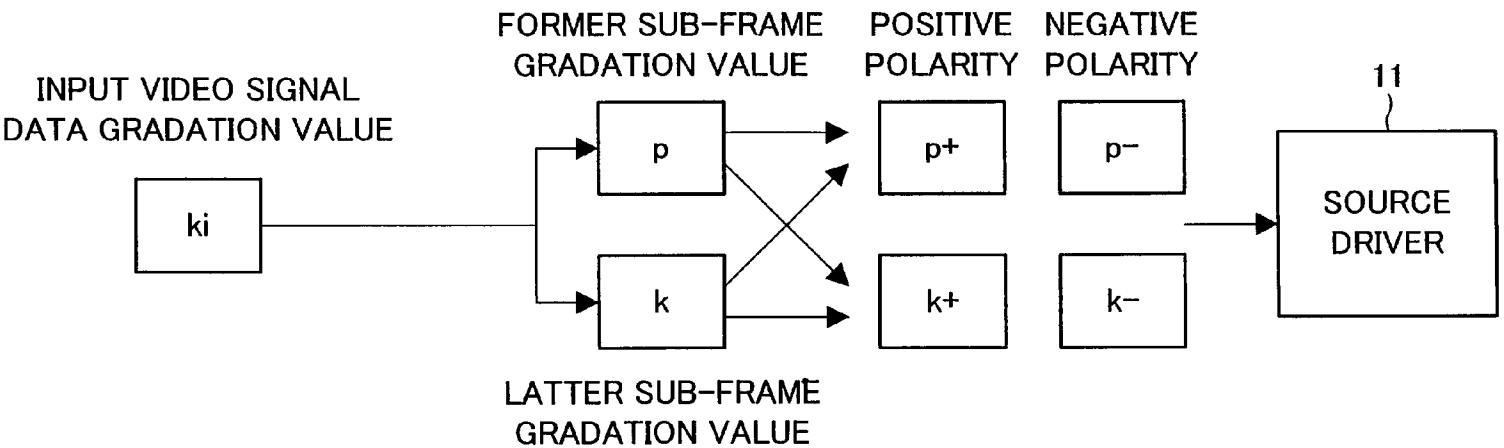
FIG. 2 illustrates how data of an input video signal data gradation value is converted in the liquid crystal display device.
Figure 3:
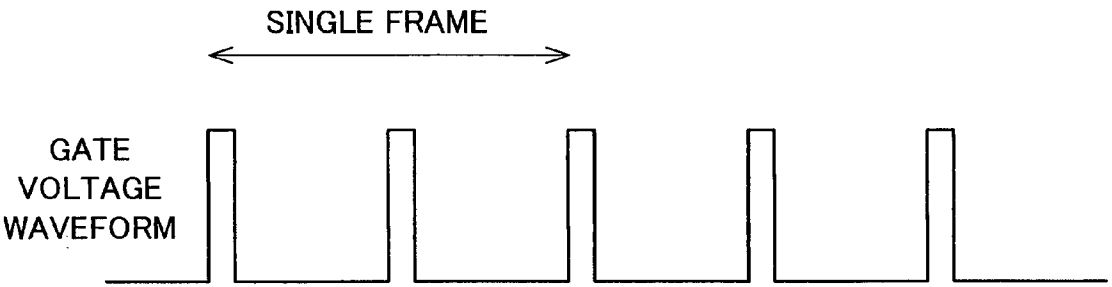
FIG. 3(*a*) is a waveform chart showing a waveform of a voltage applied to a pixel of the liquid crystal display device at the time of time-division driving.
Figure 3:
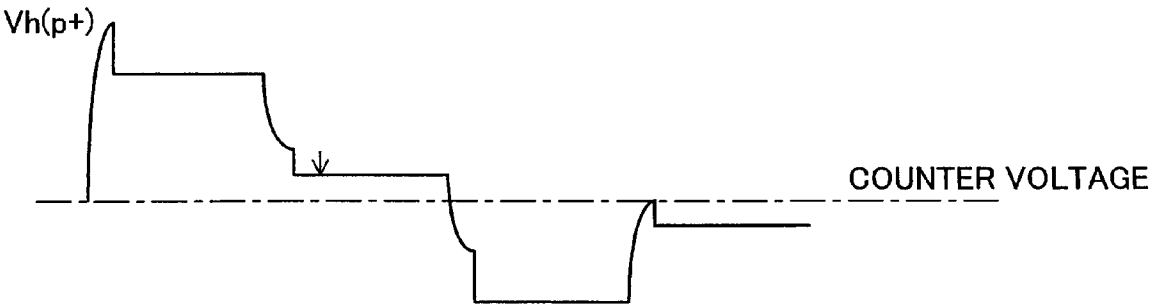
Figure 3:
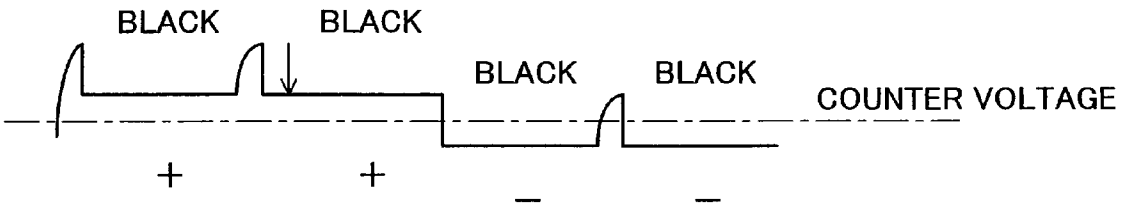

A process in which data is converted in the time-division is schematically described as follows. As shown in FIG. 2, the data input signal gradation value ki is first converted into sub-frame gradation values p and k in the time-division, and source driver input signal gradation values in positive and negative polarities in the former sub-frame are converted into p+ and p−, and source driver input signal gradation values in positive and negative polarities in the latter sub-frame are converted into k+ and k−, so as to be driver input gradation values.

The data conversion can be performed by using four conversion LUTs for converting the source driver input signal gradation values into p+, k+, p−, and k−, as to the display input signal data ki.

Figure 1:
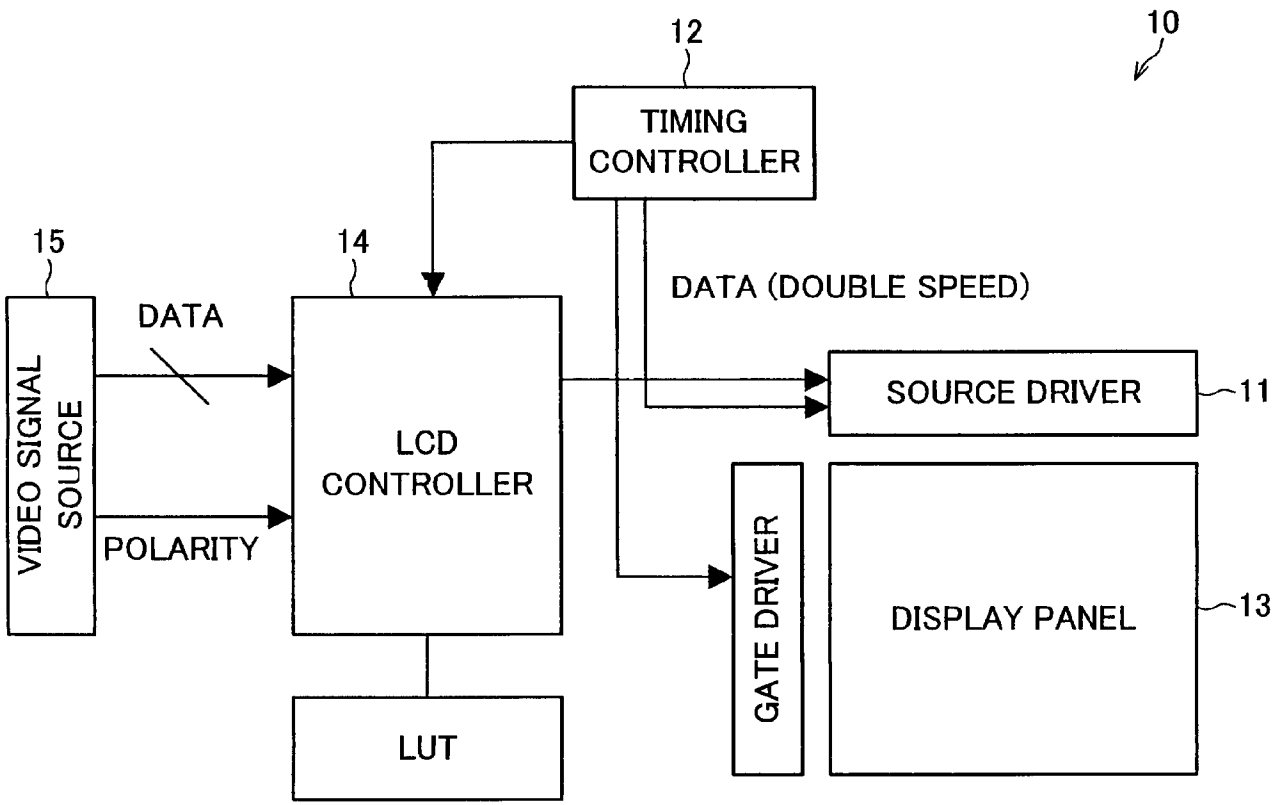
FIG. 1(*a*) is a block diagram showing one embodiment of a liquid crystal display device of the present invention.
Figure 1:
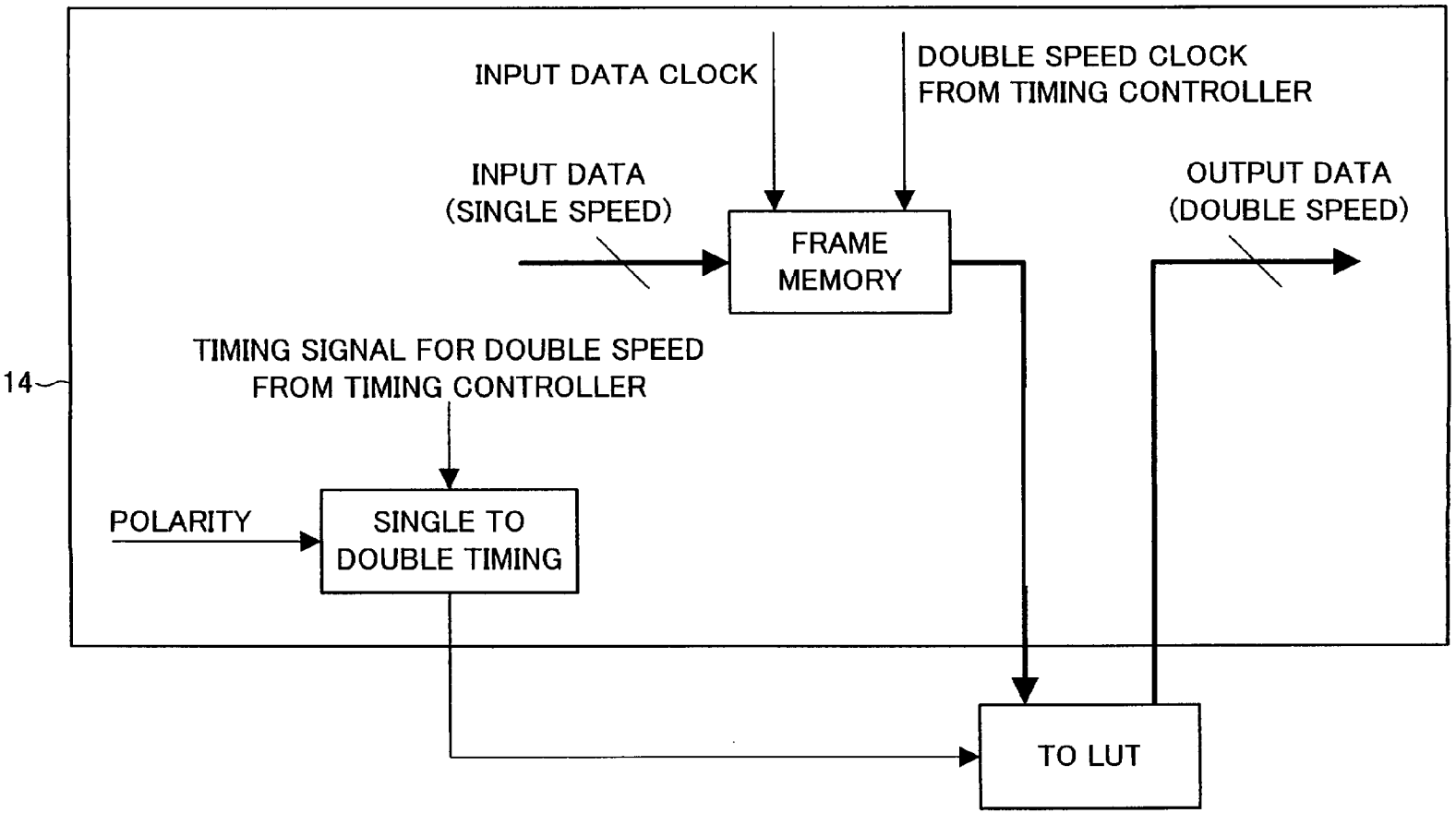
Figure 1:
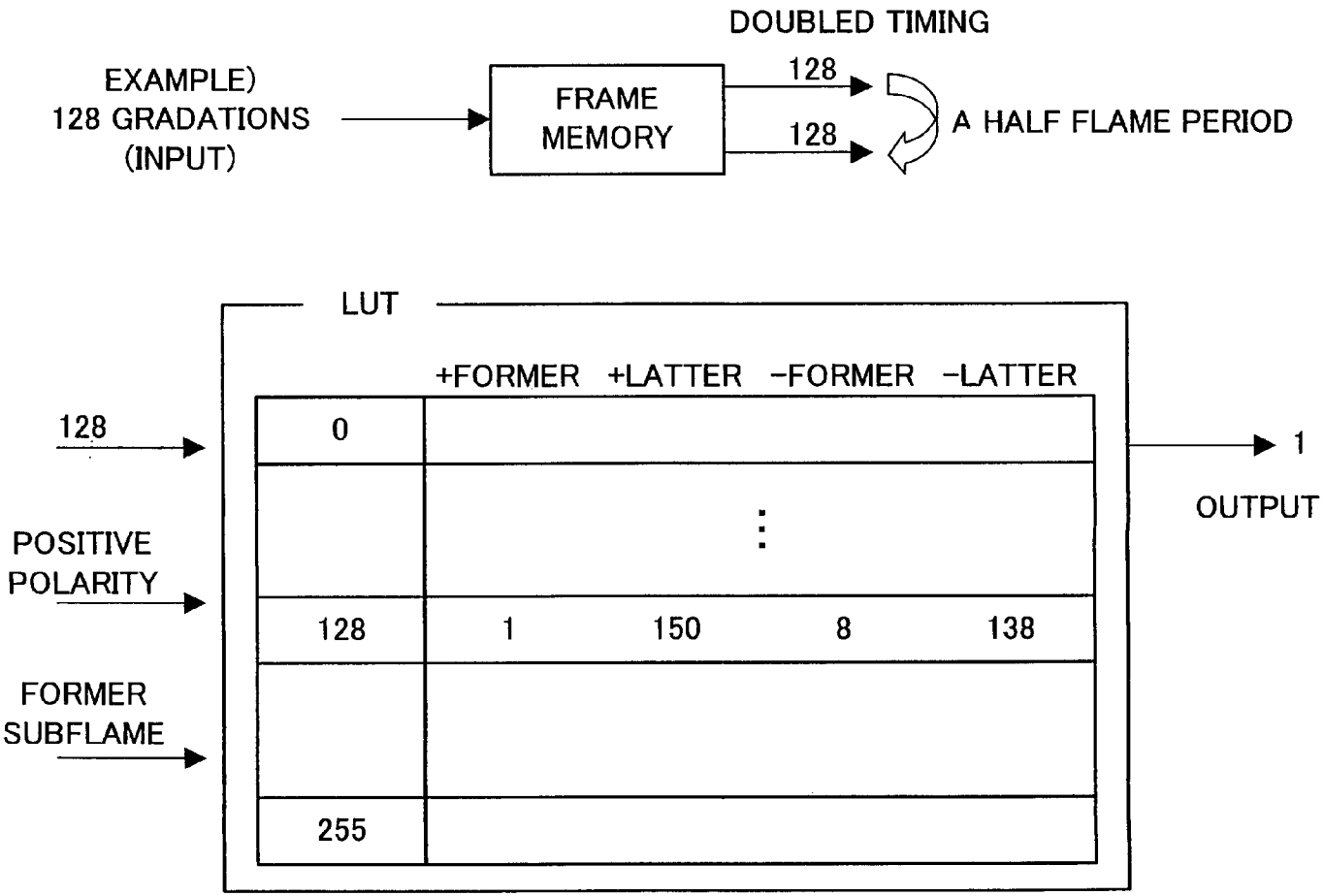

In an example embodiment, as shown in FIGS. 1(*a*)-1(*c*), when inputting data DATA to the source driver 11, the data DATA is inputted via a look-up table LUT of an LCD controller 14 which serves as applied voltage setting device. Input data to the look-up table LUT is data whose RGB data of 60 Hz have been changed into RGB data of 120 Hz, and this is inputted together with a display polarity signal. The look-up table LUT is a circuit for converting the input data into a desired output data with reference to the data DATA. A combination of output gradations with respect to the data is stored in the look-up table LUT in advance. A value of the combination varies depending on a polarity and a sub-frame. Input and output of the look-up table LUT are controlled by a timing controller 12.

FIG. 1(*b*) illustrates one example of details of the LCD controller 14, and its cooperation with the LUT. As shown in FIG. 1(*b*), the LUT stores data for each polarity and each sub-frame, with respect to the input gradation data. In a case where gradation data is inputted to the LCD controller 14 as shown in FIG. 1(*b*), the data is converted, in this example embodiment, into double speed data by using the illustrated frame memory, for example. The data from the frame memory is then converted by the LUT in accordance with a polarity and a sub-frame at the time of output (supplied to the LUT as shown in FIG. 1 (*b*) for example), and the thus converted data is then output as shown. The frame memory may be a DRAM, SDRAM, FIFO, or any other memory capable of perform the function described above.

FIG. 1(*c*) shows an example of the operation of the frame memory of the LCD controller 14 as shown in FIG. 1(*b*). In the case where 128 gradations are inputted, for example, signal data thereof is inputted to the frame memory. The data is outputted twice at an interval of a half frame period in a single frame. At the time of output in the former sub-frame, 128-data is, inputted to the LUT. With respect to the 128-data, the LUT stores, in advance, four sets of data corresponding to the former and latter sub-frames and positive and negative polarities. As exemplified as follows, an output of the LUT is 1 in response to a positive polarity input in the former sub-frame.

Further, in the case of a positive polarity in the latter sub-frame, 150 is outputted so as to be inputted to the panel (source driver) at a double frequency. In the case of a negative polarity in the former sub-frame, 6 is outputted so as to be inputted to the panel (source driver) at a double frequency. In the case of a negative polarity in the latter sub-frame, 138 is outputted so as to be inputted to the panel (source driver) at a double frequency. Data stored in the LUT has a value obtained by estimating pull-in of a voltage outputted from the source driver.

As to the source driver, 0 to 255 output voltages are determined for each of positive and negative polarities. From 255×2 voltages, an optimal voltage is calculated for each sub-frame and each polarity. Thus, calculated optical voltage is stored in the LUT.

As exemplified above, when 128 gradations are inputted, each output in the former sub-frame is a black voltage output (1 in the positive polarity and 6 in the negative polarity). In the case where values (150 in the positive for example and 138 in the negative for example) are obtained by estimating pull-in in advance, assuming the 128 gradations in the latter sub-frame will result in the black voltage output (1 in the positive polarity and 6 in the negative polarity) in the former sub-frame are. stored in the LUT in advance, it is not necessary to store the former sub-frame.

Essentially, as long as one of a former or latter sub-frame is a known value (resulting in the black voltage output or a white voltage output, for example, or a known relative minimum or minimum, or relative maximum or maximum for example), the LCD controller 14 as set forth above can know that the other sub-frame (either former or latter, whichever one is not known) must be determined. Once this is known, the correct information can be obtained from the LUT.

However, it should be understood that a second delay memory configuration, including an extra memory for receiving and delaying comparison of a former or latter sub-frame to an LUT while the other of the former and latter sub-frame is being compared to the LUT, could alternatively be used wherein each of the former and latter sub-frame values are stored and then compared to a single or separate LUTs. As each sub-frame is first stored in memory, simple comparisons may be made to the LUT.

An overall example is now provided where the look-up table (LUT) carries out the conversion. Table 1 shows an example of a simple conversion. Note that, in an example embodiment, the look-up table LUT is arranged as follows: a frame is divided into two sub-frames, and a combination of the sub-frames is made so that a relative minimum or minimum; or a relative maximum or maximum luminance is displayed in one sub-frame.

Here, it is natural that the luminance gradation is minimum or maximum. However, actually, it is found that it is possible to obtain the same effect merely by bringing the luminance close to minimum or maximum (for example, merely setting the luminance gradation to a relative minimum of not more than a first value, e.g. 0.02% of the maximum or to a relative maximum of not more than a second value, e.g. 80% of the maximum). Thus, the value can be a relative minimum or relative maximum.

TABLE 1

| Input signal gradation number Ki | Positive former sub-frame p+ | Positive latter sub-frame k+ | Negative former sub-frame p− | Negative latter sub-frame k− |
|---|---|---|---|---|
| Example of Input | | | | |
| 0 | 0 | 0 | 4 | 4 |
| 64 | 1 | 63 | 3 | 65 |
| 128 | 2 | 128 | 2 | 128 |
| 196 | 3 | 193 | 1 | 191 |
| 255 | 4 | 255 | 0 | 251 |

That is, as shown in FIG. 1, when the data input signal gradation value ki is 64 which is halftone for example, the positive former sub-frame gradation value (p+)=1, the positive latter sub-frame gradation value (k+)=63, the negative former sub-frame gradation value (p−)=3, the negative latter sub-frame gradation value (k−)=65. Meanwhile, when the data input signal gradation value ki is 128 which is halftone, the positive former sub-frame gradation value (p+)=2, the positive latter sub-frame gradation value (k+)=128, the negative former sub-frame gradation value (p−)=2, the negative latter sub-frame gradation value (k−)=128. As described, in case of the halftone, the positive former sub-frame gradation value (p+), the positive latter sub-frame gradation value (k+), the negative former sub-frame gradation value (p−), the negative latter sub-frame gradation value (k−) are changed according to the data input signal gradation value ki.

Further, when the data input signal gradation value ki is black display, the positive former sub-frame gradation value (p+)=0, the positive latter sub-frame gradation value (k+)=0, the negative former sub-frame gradation value (p−)=4, the negative latter sub-frame gradation value (k−)=4.

In this manner, the data is converted and the data DATA is inputted to the source driver 11, so that deviation of the direct current component DC in each sub-frame polarity in a combination of some sub-frames may be improved. As a result, a liquid crystal voltage in a positive polarity and a liquid crystal voltage in a negative polarity are the same at the time of black writing in the sub-frame. Each of FIGS. 3(*a*) to 3(*c*) shows a waveform of a voltage applied to the pixel in this case.

An improvement effect is described as follows, in terms of "before modification" and "after modification", with reference to FIGS. 4(*a*) and 4(*b*).

Figure 4:
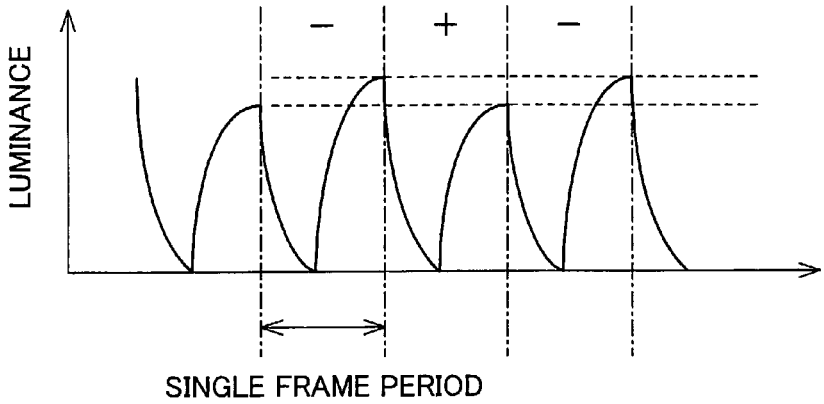
FIG. 4(*a*) is a waveform chart showing an output luminance of an unmodified display panel of the liquid crystal display device.
Figure 4:
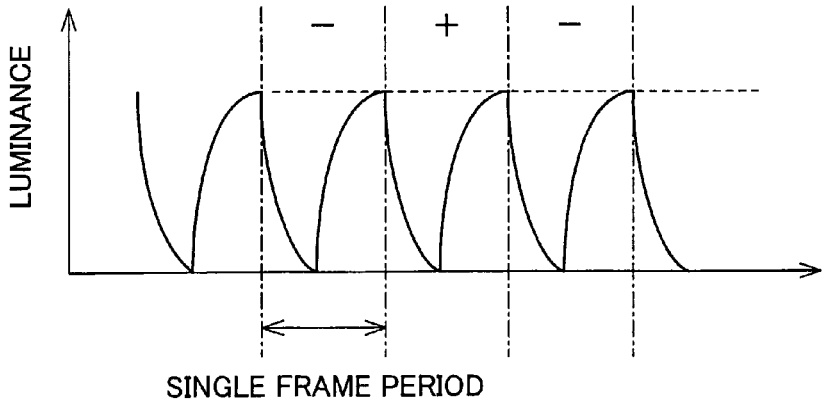

For example, as shown in FIG. 4(*a*), in case of 94 gradation output, data which has been converted in positive and negative polarities is as follows: The former sub-frame data is 0 gradation, and the latter sub-frame data is 193 gradations. Thus, a luminance outputted in the positive writing and a luminance outputted in the negative writing are different from each other. This is because a positive voltage applied to liquid crystal and a negative voltage applied to the liquid crystal are different from each other, which results in a problem such as a flicker.

Note that, outputting of 94 gradations may be based on an arithmetical average of (i) 0 gradation of the former sub-frame data and (ii) 188 gradations of the latter sub-frame data, but the foregoing arrangement is not based on such an arithmetical average. This is because, in case of outputting in the display panel 13, γ correction is performed so as to perform gradation display in terms of a luminance.

In contrast, after the modification, data in the positive polarity and data in the negative polarity are different from each other. Thus, the data is converted into the data DATA so that: the positive former sub-frame data is 0 gradation, and the positive latter sub-frame data is 193 gradations, and the negative former sub-frame data is 4 gradations, and the negative sub-frame data is 195 gradations. Thereafter, the data DATA is inputted to the display panel 13. The panel luminance output in the positive polarity and the panel luminance output in the negative polarity have the same output luminance value as shown in FIG. 4(*b*).

In an example embodiment, one side is black (minimum or relatively minimum luminance) or white (maximum or relatively maximum luminance), so that there is a single combination in the positive polarity and there is a single combination in the negative polarity. Thus, the data can be converted by the look-up table LUT. These optimal values are measured in advance with respect to all the gradations, and thus measured optimal values are stored in the look-up table LUT. Note that, it does not matter whether the former sub-frame or the latter sub-frame is used to display black (minimum or relatively minimum luminance) or white (maximum or relatively maximum luminance).

As described, in the LCD controller 14, a combination of sub-frames enables such conversion that an absolute value of a voltage applied to liquid crystal in a positive polarity in a sub-frame and an absolute value of a voltage applied to liquid crystal in a negative polarity in the sub-frame are the same.

In case of black insertion in plural lines like Tokukai 2001-60078, it is impossible to perform the data conversion for correction. That is, plural scanning lines are simultaneously selected, so that source driver input gradation values in pixels of plural lines are the same. Thus, in case of such a driving method that plural scanning lines are simultaneously selected, correction conversion corresponding to a pull-in voltage is not carried out in a black application sub-frame for simultaneously selecting the plural scanning lines, and only source driver input gradation data in the other sub-frame is subjected to the data conversion in the positive and negative polarities.

In this case, there is performed such data conversion that it is possible to obtain a voltage value including a corrected component corresponding to the pull-in voltage in a black application sub-frame. The data conversion is performed in the positive polarity and the negative polarity in the other sub-frame including a corrected component corresponding to the pull-in voltage caused in the black output sub-frame, so that an average of voltages applied to the liquid crystal during two frame periods is 0. By performing such conversion, it is possible to perform such data conversion that an absolute value of a voltage applied to the liquid crystal in the positive polarity and a voltage applied to the liquid crystal in the negative polarity are the same in two frame periods.

Figure 5:
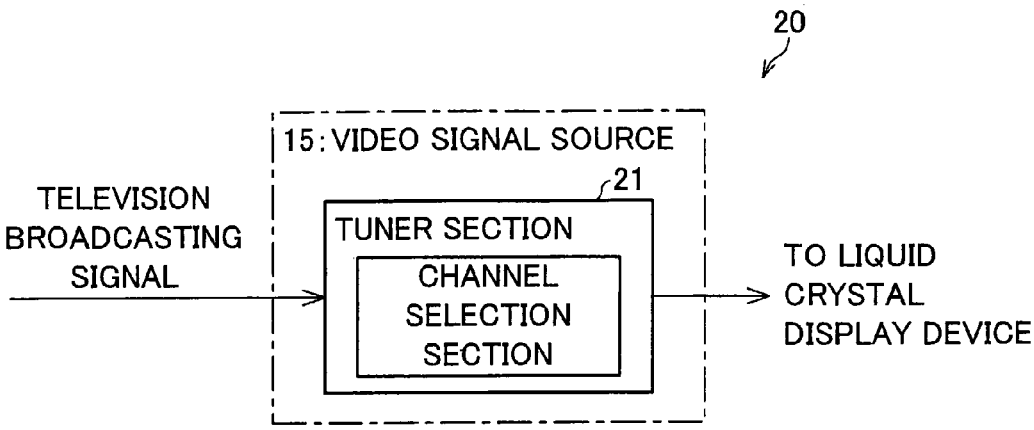
FIG. 5(*a*) is a block diagram showing an arrangement of a liquid crystal television provided with the liquid crystal display device.
Figure 5:
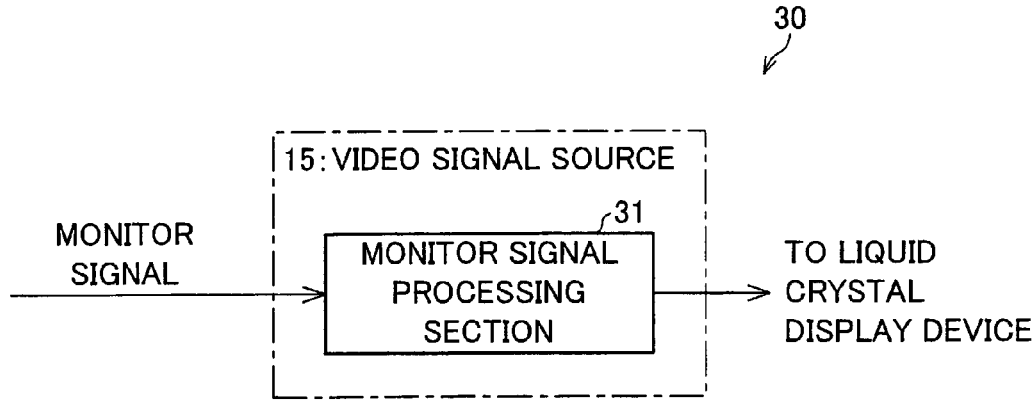

Here, as shown in FIG. 1, the liquid crystal display device 10 includes a video signal source 15 for supplying a video signal. In an example embodiment, the video signal source 15 converts a television broadcasting signal into a television video signal as shown in FIG. 5(*a*) for example. That is, the liquid crystal television 20 of an example embodiment includes not only the liquid crystal display device 10 but also a tuner section 21 for selecting a channel from the television broadcasting signal so as to output a display signal of thus selected channel as a display signal.

Note that, the video signal source 15 is not limited to this. For example, as shown in FIG. 15(*b*), the video signal source 15 can output a monitor video signal. In this case, it can be arranged so that: the liquid crystal monitor 30 includes not only the liquid crystal display device 10 but also a monitor signal processing section 31 for outputting a video monitor signal as a video signal.

In this manner, according to the liquid crystal display device 10 of an example embodiment and the method of an example embodiment for driving the liquid crystal display device 10, when applying a voltage corresponding to a gradation data signal to each pixel via the source line 8 in each sub-frame of a single frame, voltage drop caused by a gate-drain capacitance of the TFT element 6 occurs.

Thus, in an example embodiment, the LCD controller 14 is used to convert the input gradation value data of the source driver 11 in the positive and negative polarities so that the voltage drop is partially or even fully compensated, thereby setting a voltage applied to the source line.

As a result, it is possible to provide (i) the LCD controller 14 which can lessen or even avoid an influence of the voltage drop caused by a gate-drain capacitance of the TFT element 6 in case of adopting the time-division driving and (ii) a driving method of the LCD controller 14.

Further, according to the liquid crystal display device 10 of an example embodiment and the driving method of the liquid crystal display device 10, the LCD controller 14 sets a voltage applied to the source line 8 so as to compensate voltage drop corresponding to each positive voltage applied to each pixel and voltage drop corresponding to each negative voltage applied to each pixel. Thus, in case of alternately reversing polarities on the basis of a counter voltage of the counter electrode 4 in each frame so as to drive each pixel, it is possible to provide (i) the liquid crystal display device 10 which can lessen or even avoid an influence of the voltage drop caused by the gate-drain capacitance of the TFT element 6 in each polarity and (ii) the driving method of the liquid crystal display device 10.

Further, according to the liquid crystal display device 10 of an example embodiment and the driving method of the liquid crystal display device 10, by using the look-up table LUT, the LCD controller 14 can output a source driver input gradation value obtained by converting an input gradation value of an image so that it is possible to obtain a voltage value including a voltage for partially or even fully compensating voltage drop in each sub-frame. Thus, by converting a gradation signal data value inputted to the source driver in each polarity, it is possible to correct an influence of voltage drop which is caused by a gate-drain capacitance of the TFT element 6.

Further, according to the liquid crystal display device 10 of an example embodiment and the driving method of the liquid crystal display device 10, a single frame is time-divided into two sub-frames, so that it is possible to apply a voltage for minimum or relative minimum luminance display or maximum or relative maximum luminance display in at least one sub-frame.

Further, according to the liquid crystal display device 10 and the driving method of the liquid crystal display device 10, an applied voltage in one sub-frame of two sub-frames is an applied voltage for minimum or relative minimum luminance display or maximum or relative maximum luminance display. That is, a viewing angle property of a display gradation property of the display panel 13 in the liquid crystal display device 10 does not vary in case of the minimum or relative minimum luminance display (black level display) or the maximum or relative maximum luminance display (white level display). Thus, two or more writing. operations are performed in a single frame, and at least one of the writing operations is performed so as to display a minimum or relative minimum luminance (black level display) or a maximum or relative maximum luminance (white level display), thereby improving the viewing angle property.

Further, according to the liquid crystal display device 10 of an example embodiment and the driving method of the liquid crystal display device 10, an applied voltage in one sub-frame of two sub-frames is an applied voltage for minimum or relative minimum luminance display or certain luminance display. That is, a minimum or relative minimum luminance or a certain luminance is displayed in each frame, and thus obtained display is similar to display obtained by impulse driving like CRT, so that it is possible to improve a moving image display performance.

Further, according to the liquid crystal display device 10 of an example embodiment and the driving method. of the liquid crystal display device 10, the LCD controller 14 simultaneously scans every plural gate lines 9 so as to apply a voltage for minimum or relative minimum luminance display in one sub-frame of two sub-frames. In this case, the plural gate lines 9 are simultaneously selected, so that voltages for minimum or relative minimum luminance display are simultaneously applied to plural pixels, and values of the applied voltages are necessarily the same. A value indicative of voltage drop which is caused by the capacitance Cgd in applying a voltage for minimum or relative minimum luminance display to the panel pixel at the time of selection of the plural gate lines 9 is determined depending on a liquid crystal condition in the other sub-frame, so that it is impossible to apply voltages, each of which has been obtained by partially or even fully compensating the voltage drop, to the pixel electrodes on the same source line 8 that have been simultaneously selected. Thus, in applying a sub-frame voltage for minimum or relative minimum luminance display at the time of selection of the plural gate lines 9, it is impossible to perform such data conversion that the voltage drop is partially or even fully compensated by converting the source driver input gradation data.

In an example embodiment, under such condition, in another sub-frame which is different from the minimum or relative minimum luminance display sub-frame (in a former sub-frame of a second frame which occurs after the minimum or relative minimum luminance display sub-frame of a first frame), a panel pixel application signal voltage obtained by adding a component partially or even fully compensating the voltage drop is applied for minimum or relative minimum luminance display, so that an average of voltages applied to liquid crystal in two frame periods becomes 0.

That is, the correction based on the data conversion is not performed in the minimum or relative minimum luminance display sub-frame upon simultaneously selecting the gate lines 9, and data conversion is performed so that a pixel application voltage obtained by adding a component partially or even fully compensating the voltage drop is outputted in another sub-frame (in the former sub-frame of the second frame). In this conversion, a voltage in a positive polarity and a voltage in a negative polarity are different from each other in terms of a component partially or even fully compensating the voltage drop at the time of simultaneous selection of the plural gate lines 9, and an average of voltages applied to the liquid crystal in two frames becomes 0.

On this account, also in case where every plural gate lines 9 are simultaneously scanned and a voltage for minimum or relative minimum luminance display is applied in one sub-frame of the two sub-frames, it is possible to lessen or even avoid the influence of the voltage drop which is caused by the gate-drain capacitance of the TFT element 6.

Further, the liquid crystal television 20 of an example embodiment includes the liquid crystal display device 10 and a tuner section 21, serving as a video signal source 15 of the liquid crystal display device 10, which selects a channel of a television broadcasting signal so as to output a television video signal of thus selected channel as a display signal.

Thus, it is possible to provide the liquid crystal television 20 provided with the liquid crystal display device 10 which can lessen or even avoid the influence of the voltage drop which is caused by the gate-drain capacitance of the TFT element 6 in case of adopting the time-division driving.

Further, the liquid crystal monitor 30 of an example embodiment includes the liquid crystal display device 10 and a monitor signal processing section 31, serving as the video signal source 15 of the liquid crystal display device 10, which processes a monitor signal indicative of a video that should be displayed in the liquid crystal display device 10 and outputs the processed monitor signal as a video signal. Thus, it is possible to provide the liquid crystal monitor 31 provided with the liquid crystal display device 10 which can lessen or even avoid the influence of the voltage drop which is caused by the gate-drain capacitance of the TFT element 6 in case of adopting the time-division driving.

Embodiment 2

Another embodiment of the present invention is described below with reference to FIGS. 6 to 7. Note that, an example embodiment is arranged in the same manner as Embodiment 1 except for an arrangement described below. Further, for convenience in description, the same reference numbers are given to members having the same functions as members of Embodiment 1, and description thereof is omitted.

In order to lessen or even avoid the influence of the voltage drop which is caused by the gate-drain capacitance of the thin film transistor in case of adopting the time-division driving, a source driver input gradation value is converted in each polarity in Embodiment 1. However, embodiments of the present invention are not limited to such solution. It is possible to improve on or even solve the foregoing problem by arranging the liquid crystal display device so that: for example, the driver is designed so that the source driver input signal is inputted in the former and latter sub-frames and an output can be set so as to correspond to each sub-frame.

That is, the source driver may be designed so as to output $$Vp=Vp(ki,+,f)$$

$$Vp=Vp(ki,+,r)$$

$$Vm=Vm(ki,-,f)$$

$$Vm=Vm(ki,-,r)$$

when a positive polarity, a negative polarity, an f sub-frame, and an r sub-frame are set with respect to the input signal gradation ki.

Figure 17:
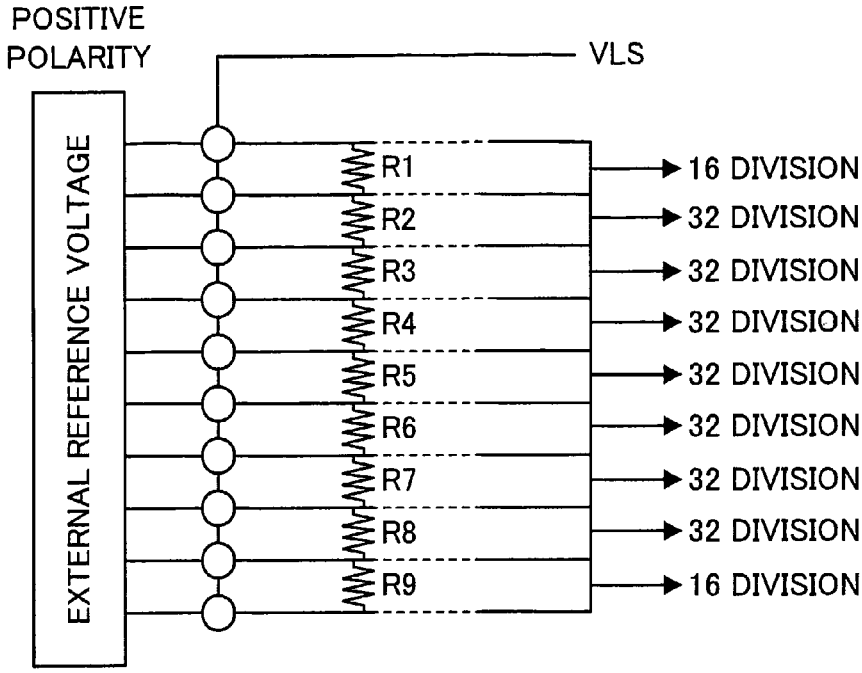
FIG. 17(*a*) is a schematic showing a frame-division output ladder resistor in a positive polarity of the source driver.
Figure 17:
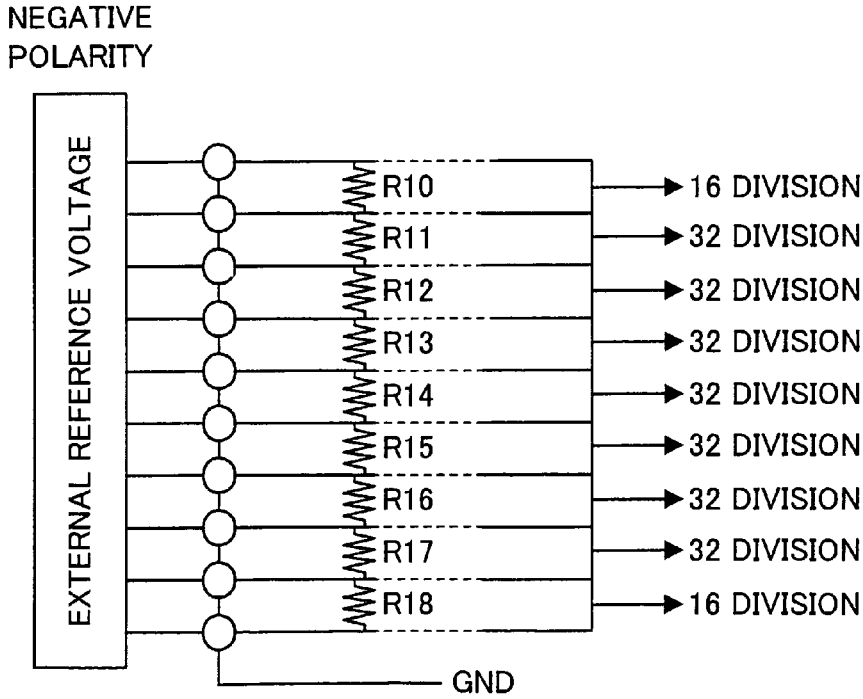

Here, as shown in FIGS. 17(*a*) and 17(*b*), generally, a reference voltage generation circuit of the source driver receives input data, a positive/negative polarity reverse signal, and former and latter signal inputs, and outputs two voltages whose values respectively correspond to positive and negative polarities.

As shown in FIGS. 17(*a*) and 17(*b*), the reference voltage generation circuit receives 10 reference voltages from a reference power source, and divides each of the reference voltages with resistors so as to obtain a determined output voltage corresponding to a gradation output. The output voltage is 1 output in each positive polarity and in each negative polarity. Each output is determined for each data.

Figure 6:
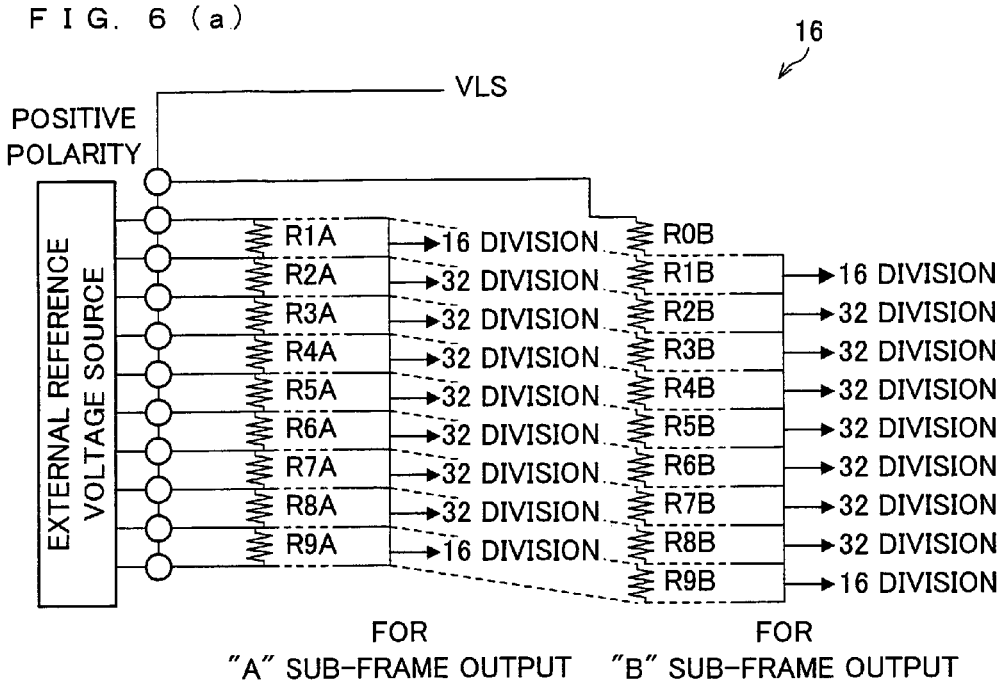
FIG. 6(*a*), showing another embodiment of the present invention, illustrates how a source driver divides an output resistance in a positive polarity.
Figure 6:
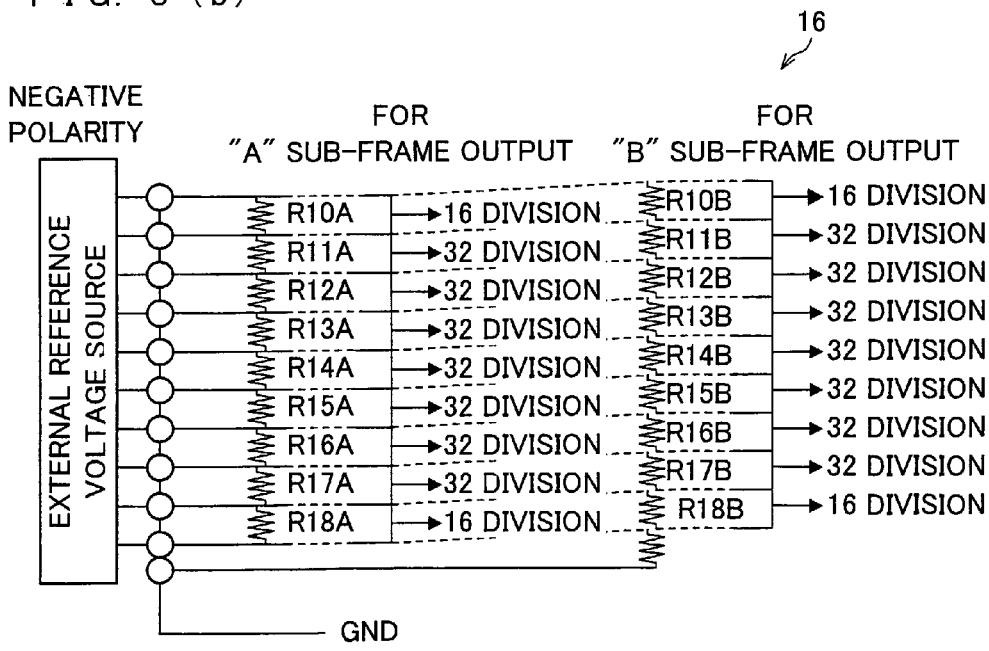

Meanwhile, as shown in FIGS. 6(*a*) and 6(*b*), a ladder resistor circuit of the reference voltage generation circuit 16 in the source driver 11 of an example embodiment is arranged so that: a frame is divided into an A sub-frame and a B sub-frame, and it is possible to set one kind of gradation data as gradation data at the time of A sub-frame output and gradation data at the time of B sub-frame output. This operation is realized by a switch (not shown). As shown in FIGS. 6(*a*) and 6(*b*), the A sub-frame and B sub-frame are identical with each other in terms of the divisional number, the reference voltage, and the like, but these values may be changed.

Further, embodiments of the present invention are not limited to these values. Note that, the ladder resistor circuit of the reference voltage generation circuit 16 shown in FIGS. 6(*a*) and 6(*b*) functions as first voltage generation device of at least one embodiment of the present invention.

As shown in FIGS. 6(*a*) and 6(*b*), in the ladder resistor circuit, an output voltage has two values in each polarity, and an output is determined according to a sub-frame. For example, in the A sub-frame, a resistor RnA (n is a natural number excluding 0) is used to display a halftone gradation. In the B sub-frame, a resistor RnB (n is a natural number excluding 0) is inserted, so that it is possible to output a voltage whose level is lower than that in the A sub-frame.

That is, in an example embodiment, a driving method in which a frame is time-divided so as to perform gradation display is adopted, and the arrangement is made on the assumption that black (minimum or relative minimum luminance) or white (maximum or relative maximum luminance) is outputted in one sub-frame.

As to a case of using a panel having a driver which allows an output voltage to be set regardless of a sub-frame, the following description explains how to set the output voltage.

First, a combination of gradation outputs should be determined. In case of general hold-mode driving, on the basis of a liquid crystal V-T property (voltage-transmittance property), an output voltage of the source driver 11 is determined so that the transmittance is the 2.2nd power of a data value so as to perform γ correction. In case where a frame is divided and an output is determined in accordance with a combination of sub-frames (particularly, in case of such driving that black (minimum or relative minimum luminance) or white (maximum or relative maximum luminance) is displayed in one sub-frame like at least one embodiment of the present invention), the transmittance relates to a response property of the liquid crystal, so that a voltage value can be determined in accordance with a transmittance property: (i) a relationship between a minimum or relative minimum transmittance voltage and a certain voltage and (ii) a relationship between a maximum or relative maximum transmittance voltage and a certain voltage.

Further, even in a sub-frame for outputting a minimum or relative minimum luminance and a maximum or relative maximum luminance, a different voltage should be output as an output voltage depending on the combination of gradations.

Figure 7:
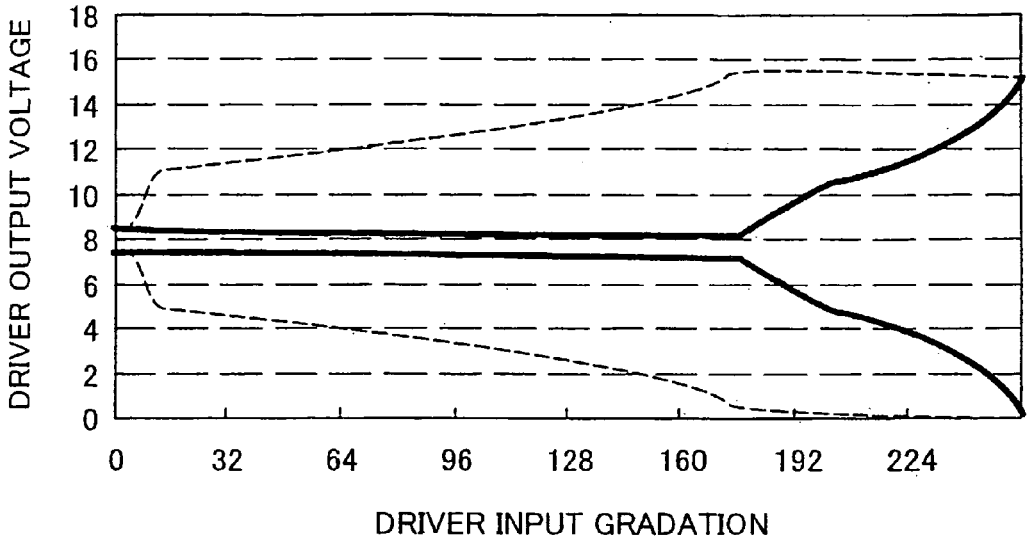
FIG. 7 illustrates a relationship between an input gradation and an output gradation in the liquid crystal display device.

An example of a relationship between an input data gradation and output voltage setting is shown in FIG. 7. In FIG. 7, an uppermost broken line indicates a voltage set in a positive polarity in the A sub-frame, and an upper thick line indicates a voltage set in a positive polarity in the B sub-frame, and a lower thick line indicates a voltage set in a negative polarity in the B sub-frame, and a lower broken line indicates a voltage set in a negative polarity in the A sub-frame.

By setting voltages in this manner, an absolute value of a voltage applied to liquid crystal in a positive polarity and an absolute value of a voltage applied to the liquid crystal in a negative polarity are the same, so that there is no luminance difference in a panel output. That is, unlike a conventional arrangement in which the source driver 11 outputs two output voltages (positive and negative) so as to correspond to a single gradation input, an example embodiment is arranged so that the source driver 11 outputs as many output voltages as a number obtained by doubling plural output groups including a combination of sub-frame outputs.

According to the liquid crystal display device 10 of an example embodiment and an example embodiment of the driving method of the liquid crystal display device 10, plural combinations of output voltages (a former sub-frame voltage and a latter sub-frame voltage, and a positive polarity voltage and a negative polarity voltage) of source drivers are switched over so as to correspond to an image input gradation value, so that it is possible to lessen or even avoid the influence of the voltage drop which is caused by the gate-drain capacitance of the TFT element 6. In this manner, also by using a hardware, it is possible to lessen or even avoid the influence of the voltage drop which is caused by the gate-drain capacitance of the TFT element 6.

Embodiment 3

Another embodiment of the present invention is described below with reference to FIGS. 18 to 23. Note that, an example embodiment is arranged in the same manner as Embodiment 1 except for an arrangement described below. Further, for convenience in description, the same reference numbers are given to members having the same functions as members of Embodiment 1, and description thereof is omitted.

In Embodiment 2, the reference voltage generation circuit 16 prepares plural combinations of output voltages respectively corresponding to positive and negative polarities in the former sub-frame and positive and negative polarities in the latter sub-frame in an entire range from 0 gradation 0 to 255 gradations.

Figure 18:
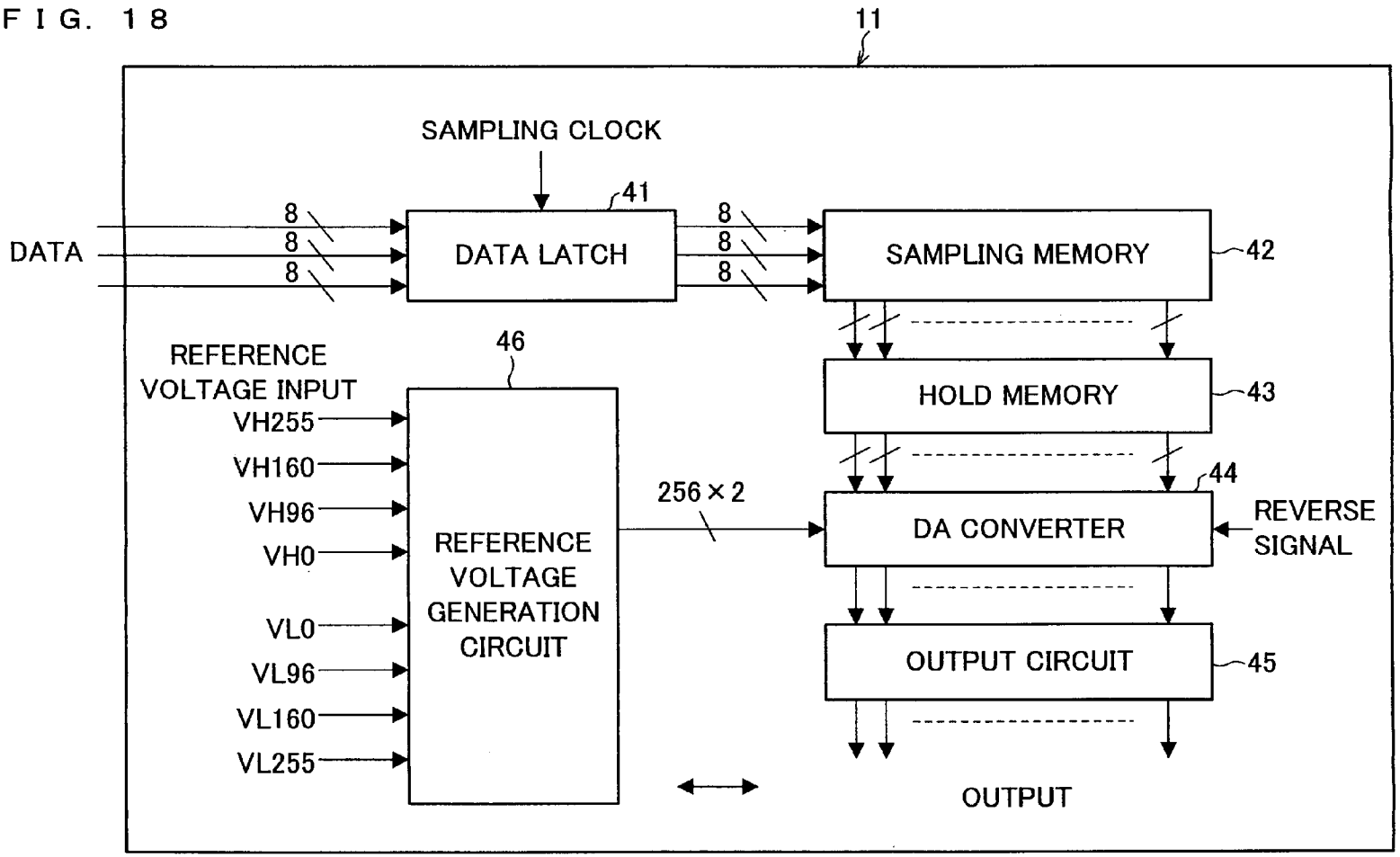
FIG. 18, showing another embodiment of the present invention, is a block diagram showing an arrangement of a source driver.

Meanwhile, an example embodiment describes a reference voltage generation circuit in which a large number of black (minimum or relative minimum luminance) voltages and a large number of white (maximum or relative maximum luminance) voltages are outputted. FIG. 18 shows an internal structure of an 8-bit digital source driver.

First, generally, a digital source driver 11 includes a data latch circuit 41, a sampling memory circuit 42, a hold memory circuit 43, a DA converter 44, an output circuit 45, and a reference voltage generation circuit 46 serving as second voltage generation device as shown in FIG. 18.

Note that, for convenience in description, in an example embodiment, 9-bit data for each of RGB is inputted to the source driver 11. Further, the source driver 11 is a dot reverse source driver 11, and four reference voltages in a positive polarity and four reference voltages in a negative polarity, that is, eight reference voltages in total (=4×2) are inputted. Actually, the number of inputs varies in each source driver 11 in accordance with usage thereof, but is basically the same. That is, in an example embodiment of the present invention, data input number (8 bits) and an output number (RGB or not) of the source driver 11 are not limited.

The data (8 bits×3) for a single line is subjected to time-division and is sequentially inputted to the source driver 11. In the source driver 11, the data is temporarily latched by the data latch circuit 41 in accordance with a sampling clock, and then is stored in the sampling memory circuit 42 in accordance with time-division so as to correspond to an operation of a shift register circuit (not shown) which shifts from the LCD controller 14 in accordance with a start pulse and a clock. Thereafter, on the basis of a horizontal synchronization signal (not shown) from the LCD controller 14, the data is collectively transferred to the hold memory circuit 43.

The data is converted into an analog voltage value by the DA converter 44 in accordance with a reference voltage of each gradation level which has been generated by the reference voltage generation circuit 46.

Figure 19:
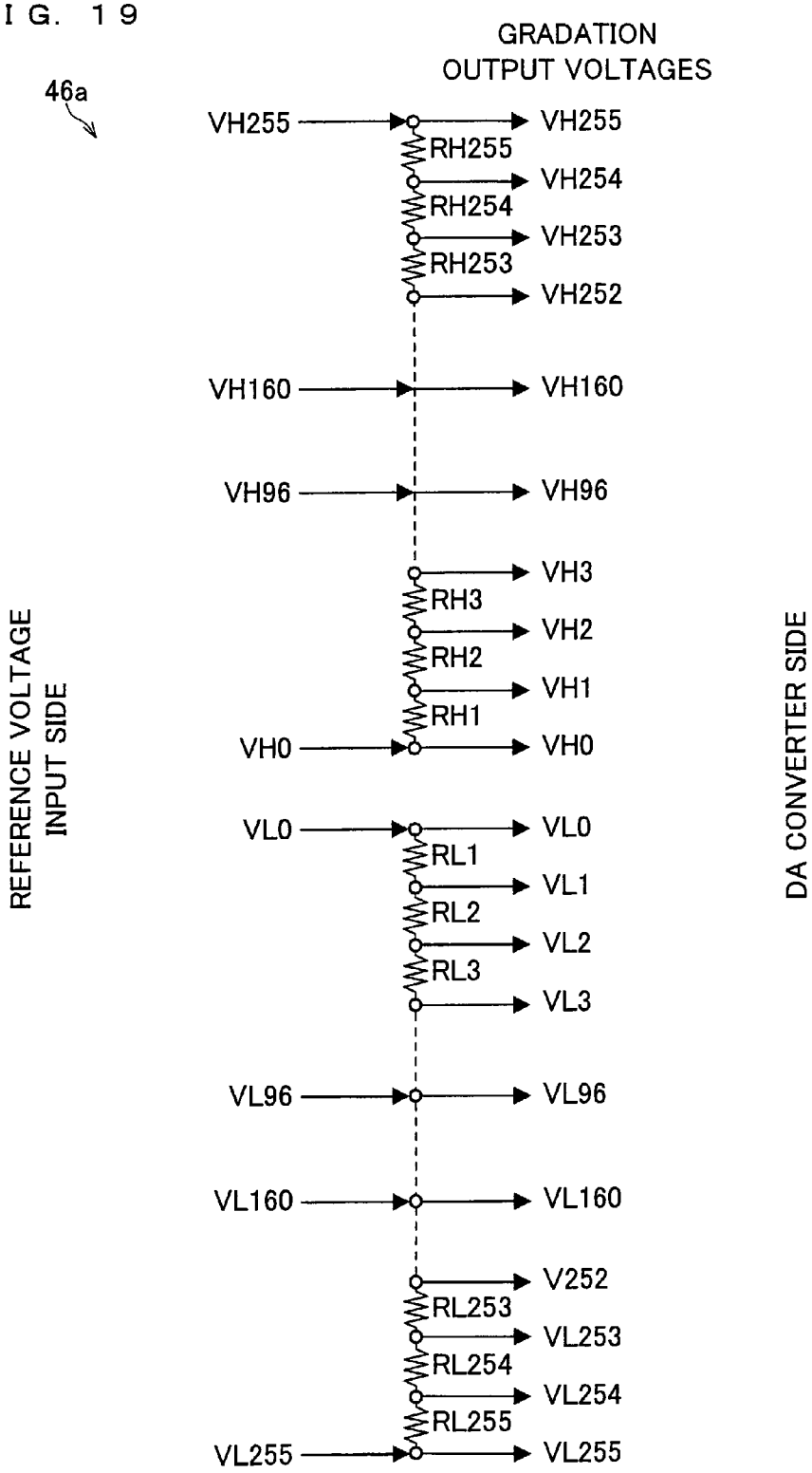
FIG. 19 illustrates an arrangement of a ladder resistor of a reference voltage generation circuit in the source driver.

As described above, the voltage value converted by the DA converter 44 is generated by the reference voltage generation circuit 46. In a ladder resistor circuit **46*a* of the reference voltage generation circuit 46, as shown in FIG. 19**, a voltage is subjected to resistor-division on the basis of a voltage inputted as a reference voltage. Further, as a voltage corresponding to each gradation, voltage value outputs in positive and negative polarities (256×2 outputs in total) are generated.

Figure 20:
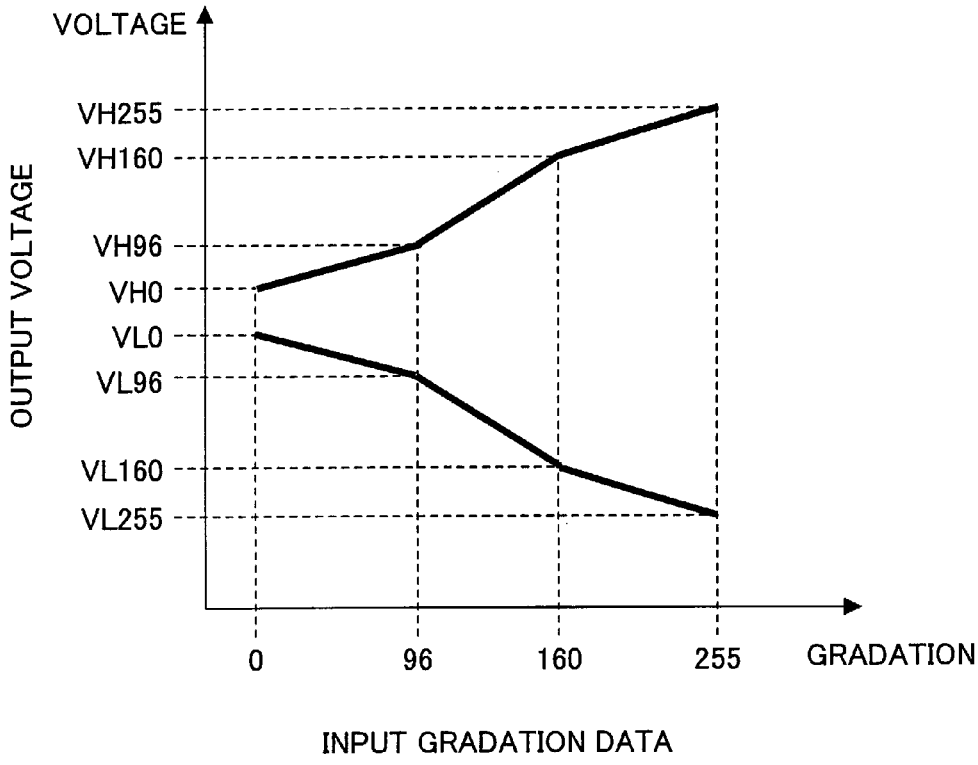
FIG. 20 is a graph showing a relationship between input gradation data and an output voltage in case of normally black.

An output voltage with respect to input gradation data is as shown in FIG. 20.

In a general driving method, the reverse signal is reversed in each frame, and the pixel electrode outputs a positive voltage (VH) and a negative voltage (VL) to the display panel 13 alternately in each frame. Thus, a gradation voltage Vn applied to liquid crystal in performing n gradation display is as follows.

$$Vn=(VHn-VLn)/2$$

That is, the gradation voltage Vn indicates a potential difference between the pixel electrode and the counter electrode.

In the source driver 11 of an example embodiment, as in Embodiment 1 and Embodiment 2, a polarity of a voltage applied to the pixel varies in each frame, and a frame period is time-divided into two or more sub-frame periods, and gradation luminance display is performed so that black (minimum or relative minimum luminance) or white (maximum or relative maximum luminance) is displayed in at least one of the sub-frames.

Further, in the source driver 11 of an example embodiment, a large number of black (minimum or relative minimum luminance) voltages or a large number of white (maximum or relative maximum luminance) voltages are outputted. Thus, a large number of output voltages applied to the liquid crystal of the pixel are identical with each other.

Note that, an example embodiment above explains the case of normally black, but embodiments of the present invention are not limited to this. At least one embodiment of the present invention may be adopted to the case of normally white. In this case, white may be a minimum or relative minimum luminance and black may be a maximum or relative maximum luminance.

Figure 21:
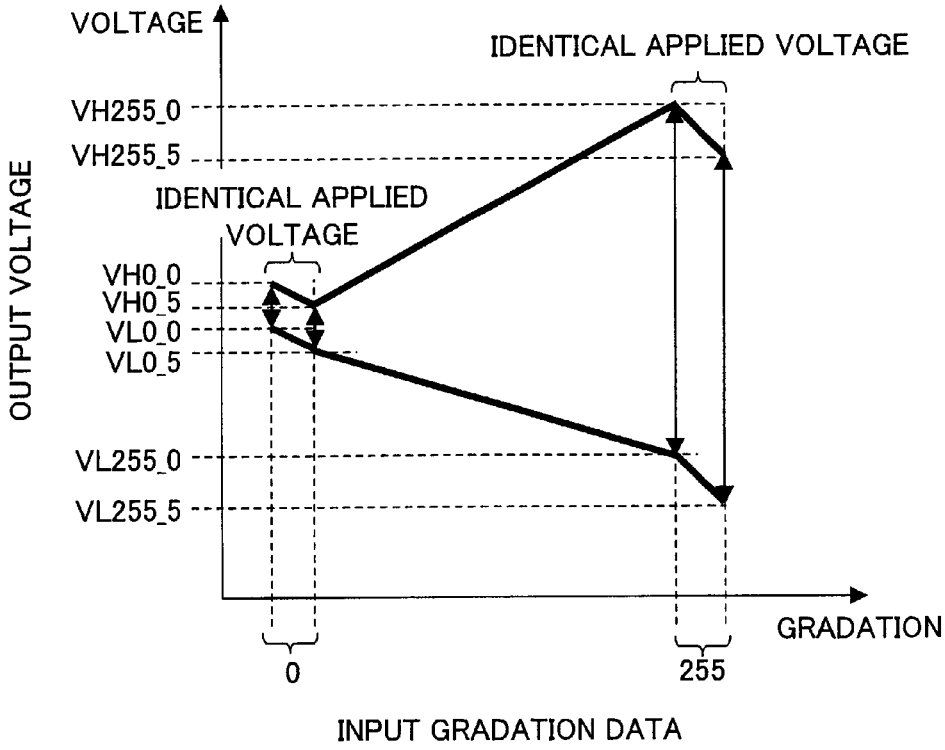
FIG. 21 is a graph showing a relationship between input gradation data and an output voltage in case where a large number of relatively black (relatively minimum luminance) voltages and a large number of relatively white (relatively maximum luminance) voltages are outputted in the source driver.

Specifically, as shown in FIG. 21, five output voltages are prepared with respect to 0 gradation and 255 gradations in the input gradation data. However, if not necessary, the output voltages may be prepared only on the side of 0 gradation or only on the side of 255 gradations.

Incidentally, as shown in FIG. 20 described above, a general source driver is designed so that an output voltage monotonously increases in a positive polarity (VH) and monotonously decreases in a negative polarity (VL). Thus, according to the design of the general source driver, as shown in 0 gradation of the input gradation data in FIG. 21, it is impossible to obtain such an output voltage that an output voltage in a positive polarity (VH) monotonously decreases with the same slant as that of an output voltage in a negative polarity (VL).

This is because: a ladder resistor circuit 46*a* of a general reference voltage generation circuit 46 is arranged so that values of resistors in positive and negative polarities are symmetric with respect to each other.

That is, this is expressed by the following equation.

$$RH(k),=RL(k)$$

where a resistance value in a positive polarity is represented by RHn (n is a natural number not less than 1) and a resistance value in a negative polarity is represented by RLn (n is a natural number not less than 1). Note that, k is a natural number ranging from 1 to n.

Thus, according to the arrangement of the ladder resistor circuit 46*a*, it is impossible to obtain such an output voltage that its slant in a positive polarity (VH) in 0 gradation and 255 gradations of the input gradation data is the same as a slant in a negative polarity.

Figure 22:
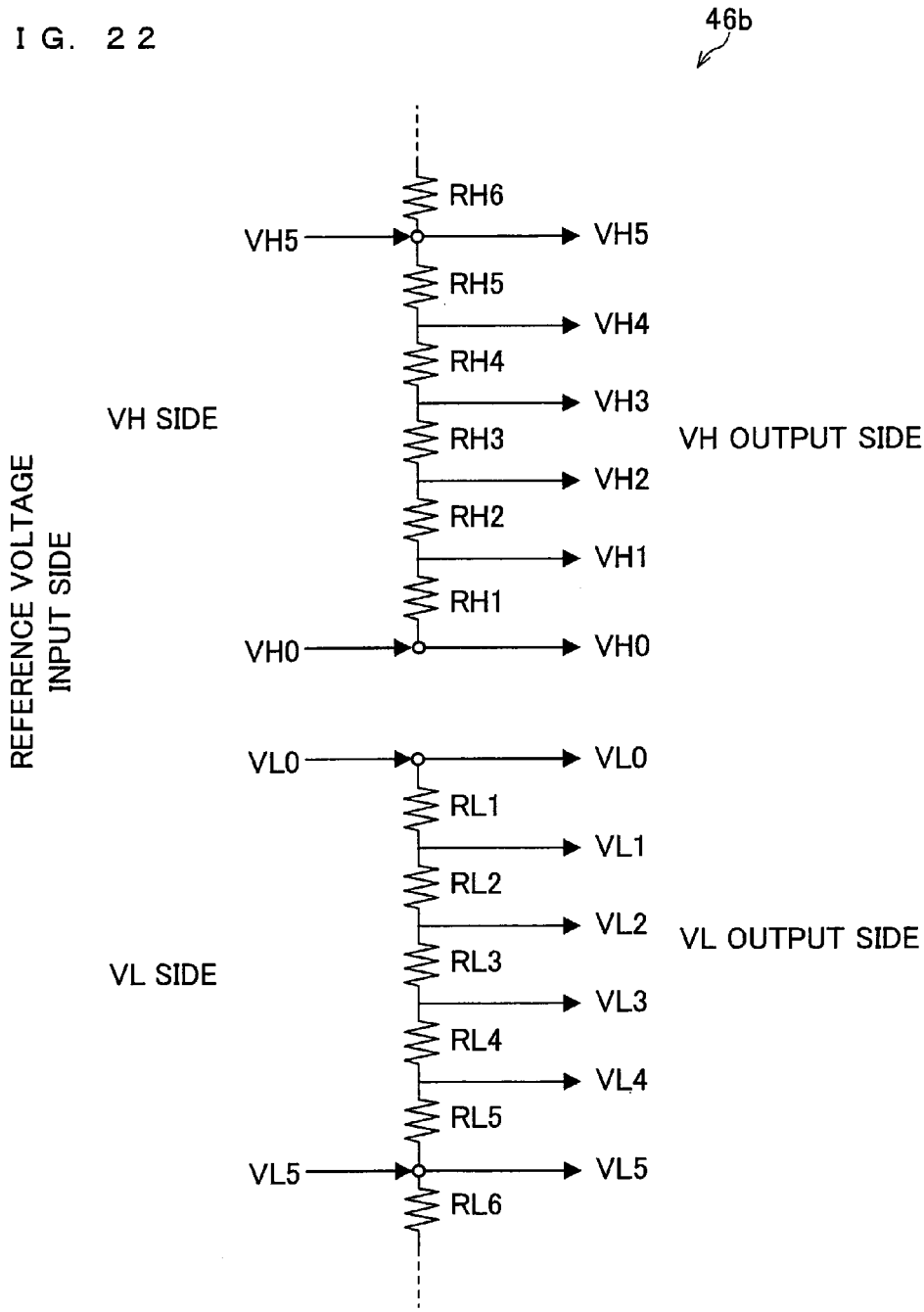
FIG. 22 illustrates an arrangement of a ladder resistor positioned on the side of relatively black (relatively minimum luminance) in the reference voltage generation circuit of the source driver.

Thus, in an example embodiment, the ladder resistor circuit 46*b* in 0 gradation (black=minimum or relative minimum luminance) adopts the arrangement shown in FIG. 22 and a unique method for retrieving the output voltage.

That is, as shown in FIG. 22, in the ladder resistor circuit 46*b* serving as minimum or relative minimum luminance plural-output device and a third ladder resistor circuit of the reference voltage generation circuit 46 of an example embodiment, received reference voltages are: a reference voltage input VH0 and a reference voltage input VH5; and a reference voltage input VL0 and a reference voltage input VL5. Further, output voltages obtained by respectively dividing the reference voltages are determined in accordance with resistance values RH1 to RH5 and resistance values RL1 to RL5. On the basis of the reference voltages VH0 ·VH5 and the reference voltages VL0·VL5, gradation voltages V0, V1, V2, V3, V4, and V5 are outputted.

When such arrangement is adopted to a conventional technique, a voltage applied to the pixel of the liquid crystal panel 7 is as follows.

$$Vn=(VHn-VLn)/2$$

On. the other hand, in an example embodiment, the gradation voltages VH0, VH1, VH2, VH3, VH4, VH5 and the gradation voltages VL0, VL1, VL2, VL3, VL4, VL5 are outputted as output voltages of 0 gradation.

In this case, in an example embodiment, the output voltages are as follows.

$$V00=(VH0-VL5)/2$$

$$V01=(VH1-VL4)/2$$

$$V02=(VH2-VL3)/2$$

$$V03=(VH3-VL2)/2$$

$$V04=(VH4-VL1)/2$$

$$V05=(VH5-VL0)/2$$

where V00=V01=V02=V03=V04=V05.

Further, input tap voltages are as follows.

$$VH5-VH0=VL0-VL5$$

Resistance values between taps are as follows.

$$RH1=RL5,\ RH2=RL4,\ RH3=RL3,\ RH4=RL2,\ RH5=RL1.$$

The resistance values are expressed by the following equation. When n number of resistors (n is a natural number not less than 2) are provided between a first reference voltage input tap and a next reference voltage input tap in a positive polarity and n number of resistors are provided between a first reference voltage input tap and a next reference voltage input tap in a negative polarity and resistance values of the resistors in the positive polarity are sequentially RH(1) to RH(n) and resistance values of the resistors in the negative polarity are sequentially RL(1) to RL(n), $$RH(k)=RL(n+1-k)(k \text{ is a natural number ranging from } 1 \text{ to } n).$$

Further, in case of outputting black (V00) in the source driver 11: VH0 is outputted in a positive polarity (VH), and data is controlled with the LCD controller 14 so as to output VL5 in a negative polarity (VL) or the source driver 11 is arranged so as to have a function for converting the data. This condition is expressed as follows.

$$V00 \rightarrow VH0,\ VL5$$

In this case, also other blacks (V01 to V05) are expressed as follows.

$$V01 \rightarrow VH1,\ VL4$$

$$V02 \rightarrow VH2,\ VL3$$

$$V03 \rightarrow VH3,\ VL2$$

$V04 \rightarrow VH4,\ VL1$ $V05 \rightarrow VH5,\ VL0$

Further, as to these values, the data may be controlled with the LCD controller 14, or the source driver 11 may be arranged so as to have a function for converting the data.

The foregoing relationship is as follows. When n number of resistors (n is a natural number not less than 2) are provided between a first reference voltage input tap and a next reference voltage input tap in a positive polarity and n number of resistors are provided between a first reference voltage input tap and a next reference voltage input tap in a negative polarity and terminal voltages of the resistors in the positive polarity are sequentially VH(0) to VH(n) and terminal voltages of the resistors in the negative polarity are sequentially VL(0) to VL(n) and VH(n)−VH(0)=VL(0)−VL(n), and an output voltage VH(k) is outputted in the positive polarity and an output voltage VL(n+1−k) is outputted in the negative polarity. Note that, k is a natural number ranging from 0 to n.

Further, the driving is controlled with the LCD controller 14 serving as identical voltage output controlling device or the source driver 11 is arranged so as to have a function for converting the data.

Figure 23:
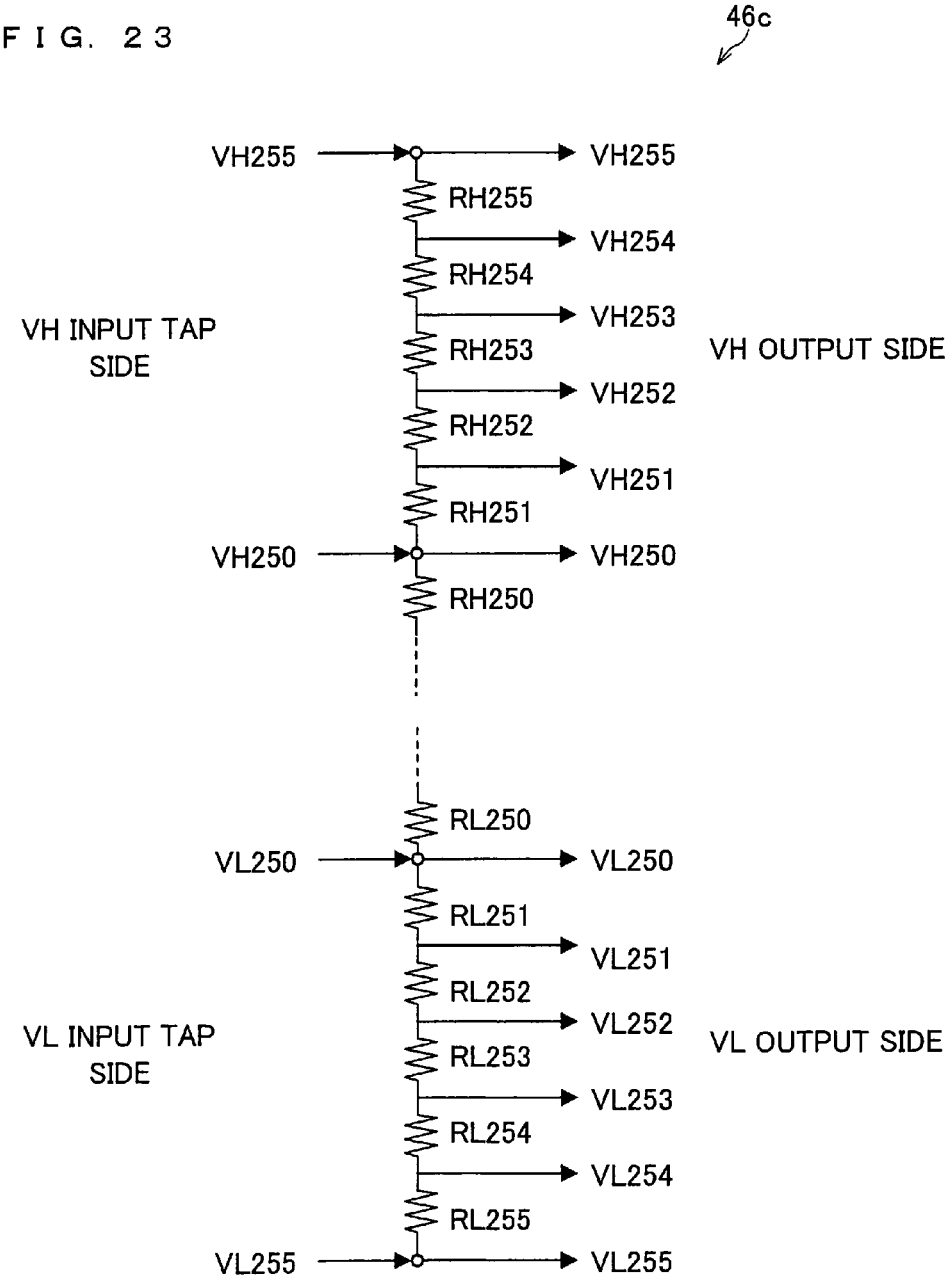
FIG. 23 illustrates an arrangement of a ladder resistor positioned on the side of relatively white (relatively maximum luminance) in the reference voltage generation circuit of the source driver.

Next, FIG. 23 shows an arrangement of a ladder resistor circuit 46*c* of an example embodiment which serves as maximum or relative maximum luminance plural-output device and a fourth ladder resistor circuit of the reference voltage generation circuit 46 on the side of 255 gradations (white=maximum or relative maximum luminance).

As shown in FIG. 23, received reference voltages are: a reference voltage input VH250 and a reference voltage input VH255; and a reference voltage input VL250 and a reference voltage input VL255. Output voltages obtained by dividing the reference voltage inputs are determined according to resistance values RH251 to RH255 and resistance values RL251 to RL255. On the basis of the reference voltages VH250•VH255 and the reference voltages VL250•L255, gradation voltages V250, V251, V252, V253, V254, and V255 are outputted.

When such arrangement is adopted to a conventional technique, a voltage applied to the pixel of the liquid crystal panel 7 is as follows.

$$Vn=(VHn-VLn)/2$$

On the other hand, in an example embodiment, the gradation voltages VH250, VH251, VH252, VH253, VH254, VH255 and the gradation voltages VL250, VL251, VL252, VL253, VL254, VL255 are outputted as output voltages of a maximum or relative maximum luminance gradation.

In this case, in an example embodiment, the output voltages are as follows.

$$V255_0=(VH250-VL255)/2$$

$$V255_1=(VH251-VL254)/2$$

$$V255_2=(VH252-VL253)/2$$

$$V255_3=(VH253-VL252)/2$$

$$V255_4=(VH254-VL251)/2$$

$$V255_5=(VH255-VL250)/2$$

where

V255_0=V255_1=V255_2=V255_3=V255_4=V255_5.

Further, input tap voltages are as follows.

$$VH255-VH250=VL250-VL255$$

Resistance values between taps are as follows.

$$RH251=RL255,\ RH252=RL254,\ RH253=RL253,\ RH254=RL252,\ RH255=RL251.$$

The resistance values are expressed by the following equation. When n number of resistors (n is a natural number not less than 2) are provided between a final reference voltage input tap and a previous reference voltage input tap in a positive polarity and n number of resistors are provided between a final reference voltage input tap and a previous reference voltage input tap in a negative polarity and resistance values of the resistors in the positive polarity are sequentially RH(max) to RH(max−n+1) and resistance values of the resistors in the negative polarity are sequentially RL(max) to RL(max−n+1), $$RH(\max+1-k)=RL(\max-n+k)\ (k \text{ is a natural number ranging from 1 to } n).$$

Further, in case of outputting white (V255) in the source driver 11: VH250 is outputted in the positive polarity (VH), and data is controlled with the LCD controller 14 so as to output VL255 in the negative polarity (VL) or the source driver 11 is arranged so as to have a function for converting the data. This condition is expressed as follows.

$$V255_0 \rightarrow VH250,\ VL255$$

In this case, also other whites (V255_1 to V255_5) are as follows.

$$V255_1 \rightarrow VH251,\ VL254$$

$$V255_2 \rightarrow VH252,\ VL253$$

$$V255_3 \rightarrow VH253,\ VL252$$

$$V255_4 \rightarrow VH254,\ VL251$$

$$V255_5 \rightarrow VH255,\ VL250$$

Further, as to these values, the data should be controlled with the LCD controller 14, or the source driver 11 should be arranged so as to have a function for converting the data.

The foregoing relationship is as follows. When n number of resistors (n is a natural number not less than 2) are provided between a final reference voltage input tap and a previous reference voltage input tap in a positive polarity and n number of resistors are provided between a final reference voltage input tap and a previous reference voltage input tap in a negative polarity and terminal voltages of the resistors in the positive polarity are sequentially VH(max) to VH(max−n) and terminal voltages of the resistors in the negative polarity are sequentially VL(max) to VL(max−n) and VH(max)−VH(max−n)=VL(max−n)−VL(max), and an output voltage VH(max−n+k) is outputted in the positive polarity and an output voltage VL(max) is outputted in the negative polarity. Note that, max is a natural number indicative of a rank of a final resistance, and k is a natural number ranging from 0 to n.

Further, the driving is controlled with the LCD controller 14 serving as identical voltage output controlling device or the source driver 11 is arranged so as to have a function for converting the data.

Due to these ladder resistor circuits 46*b* and 46*c*, it is possible to prepare a large number of black (minimum or relative minimum luminance) voltage outputs or white (maximum or relative maximum luminance) voltage outputs.

In this manner, according to the liquid crystal display device 10 of an example embodiment and the driving method of the liquid crystal display device 10, there is provided a reference voltage generation circuit 46*b* which includes both or one of: a ladder resistor circuit 46*b* for outputting a plurality of output voltages, which are identical with each other in terms of the potential difference between the pixel electrode and the counter electrode, to the pixel electrode so as to perform the minimum or relative minimum luminance display; and a ladder resistor circuit 46*c* for outputting a plurality of output voltages, which are identical with each other in terms of the potential difference between the pixel electrode and the counter electrode, to the pixel electrode so as to perform the maximum or relative maximum luminance display.

Thus, a minimum or relative minimum luminance (black in normally black) output voltage or a maximum or relative maximum luminance (white in normally black) output voltage which corresponds to an output voltage in the other sub-frame is selected from minimum or relative minimum luminance voltages or maximum or relative maximum luminance voltages, so that it is possible to compensate polarity deviation.

Further, in the liquid crystal display device 10 of an example embodiment, the ladder resistor circuit 46*b* which receives an image digital gradation value so as to generate an output voltage corresponding to each polarity has a relationship of the resistance values which is expressed by RH(k)=RL(n+1−k). As a result, also in the ladder resistor circuit, it is possible to output plural voltages, which each include a similar potential difference between the pixel electrode and the counter electrode or are even identical with each other in terms of the potential difference between the pixel electrode and the counter electrode, to the pixel electrode so as to display a minimum or relative minimum luminance. In other words, it is possible to obtain plural outputs so that voltages applied to the liquid crystal of the pixel are identical with each other.

Further, in the liquid crystal display device 10 of an example embodiment performs such control that, when a terminal voltage is VH(n)−VH(0)=VL(0)−VL(n), an output voltage VH(k) is outputted in the positive polarity and an output voltage VL(n+1−k) is outputted in the negative polarity where n is a natural number not less than 2 and k is a natural number ranging from 0 to n.

On this account, it is possible to output n+1 combinations of voltages, different from each other, in which a potential difference between the pixel electrode and the counter electrode is (VH(k)−VL(n+1−k))/2.

Further, in the liquid crystal display device 10 of an example embodiment, the ladder resistor circuit 46*c* which receives an image digital gradation value so as to generate an output voltage corresponding to each polarity has a relationship of the resistance values which is expressed by RH(max+1−k)=RL(max−n+k). As a result, also in the ladder resistor circuit, it is possible to output plural voltages, which each include a similar potential difference between the pixel electrode and the counter electrode or are even identical with each other in terms of the potential difference between the pixel electrode and the counter electrode, to the pixel electrode so as to display a maximum or relative maximum luminance.

Further, in the liquid crystal display device 10 of an example embodiment, the LCD controller 14 performs such control that, when a terminal voltage is VH(max)−VH(max−n)=VL(max−n)−VL(max), an output voltage VH(max−n+k) is outputted in the positive polarity and an output voltage VL(max) is outputted in the negative polarity.

On this account, it is possible to output n+1 combinations of voltages, different from each other, in which a potential difference between the pixel electrode and the counter electrode is (VH(max−n+k)−VL(max−k))/2.

Further, the liquid crystal display device 10 of an example embodiment can be adopted also to the liquid crystal television 20 and the liquid crystal monitor 30 that were described in Embodiment 1.

As described above, the liquid crystal display device of at least one embodiment of the present invention is arranged so that the applied voltage setting device applies a voltage whose polarities are positive and negative to the data signal line so as to alternately reverse the polarities on the basis of a counter voltage of a counter electrode in each frame so that the pixel is driven, and sets the voltage applied to the data signal line so that voltage drop in a positive polarity and voltage drop in a negative polarity are partially or even fully compensated.

Further, the method of at least one embodiment of the present invention for driving the liquid crystal display device includes: a voltage whose polarities are positive and negative being applied to the data signal line so as to alternately reverse the polarities on the basis of a counter voltage of a counter electrode in each frame so that the pixel is driven, and the voltage applied to the data signal line is set, so that voltage drop in a positive polarity and voltage drop in a negative polarity are partially or even fully compensated.

According to at least one embodiment of the invention, the applied voltage setting device sets a voltage applied to the data signal line so as to correct a voltage, applied to each pixel, which corresponds to voltage drop. Thus, in case of alternately reversing the polarity on the basis of a counter voltage of the counter electrode in each frame so that the pixel is driven, it is possible to provide (i) a liquid crystal display device which can lessen or even avoid an influence of the voltage drop which is caused by a gate-drain capacitance of the thin film transistor depending on its polarity and/or (ii) a driving method of the liquid crystal display device.

Further, the liquid crystal display device of at least one embodiment of the present invention is arranged so that the applied voltage setting device includes a look-up table for outputting conversion gradation values obtained by converting an image input gradation value into a value in a positive polarity and a value in a negative polarity so that voltage drop in each of the sub-frames is partially or even fully compensated.

Further, the method of at least one embodiment of the present invention for driving the liquid crystal display device is arranged so that a look-up table is used to input conversion gradation values, obtained by converting an image input gradation value into a value in a positive polarity and a value in a negative polarity, to a data signal line driving circuit so that voltage drop in each of the sub-frames is partially or even fully compensated.

According to at least one embodiment of the invention, the applied voltage setting device uses a look-up table to input conversion gradation values, obtained by converting an image input gradation value into a value in a positive polarity and a value in a negative polarity, to a data signal line driving circuit so that voltage drop in each of the sub-frames is partially or even fully compensated. Thus, the storage device such as the look-up table for example is used to convert the conversion data value into a value in the positive polarity and a value in the negative polarity, thereby lessening or even avoiding an influence of the voltage drop which is caused by a gate-drain capacitance of the thin film transistor.

Further, the liquid crystal display device of at least one embodiment of the present invention is arranged so that the applied voltage setting device includes a data signal line driving circuit, and the data signal line driving circuit includes a first voltage generation device provided with (i) a first ladder resistor circuit for receiving an image gradation value in one sub-frame so as to generate an applied voltage corresponding to each of the polarities and (ii) a second ladder resistor circuit for generating an applied voltage obtained by partially or even fully compensating voltage drop in a sub-frame different from the one sub-frame.

Further, the method of at least one embodiment of the present invention for driving the liquid crystal display device is arranged so that output voltages that have been set by the data signal line driving circuit so as to respectively correspond to sub-frames and so as to respectively correspond to polarities, are switched in accordance with an image input gradation value.

According to at least one embodiment of the invention, a value of the source driver output voltage corresponding to the image input gradation value is switched between a positive polarity in a former sub-frame and a negative polarity in the former sub-frame and between a positive polarity in a latter sub-frame and a negative polarity in the latter sub-frame, thereby lessening or even avoiding an influence of the voltage drop which is caused by a gate-drain capacitance of the thin film transistor. In this manner, also by using the data signal line driving circuit outputting plural voltages, it is possible to lessen or even avoid an influence of the voltage drop which is caused by a gate-drain capacitance of the thin film transistor.

Further, the liquid crystal display device of at least one embodiment of the present invention is arranged so that the single frame is time-divided into at least two sub-frames.

Further, the method of at least one embodiment of the present invention for driving the liquid crystal display device is arranged so that the single frame is time-divided into at least two sub-frames.

According to the foregoing invention, the single frame is time-divided into at least two sub-frames, so that it is possible to apply a voltage for minimum or relative minimum luminance display or maximum or relative maximum luminance display in at least one of the sub-frames.

Further, the liquid crystal display device of at least one embodiment of the present invention is arranged so that an applied voltage in at least one sub-frame of the at least two sub-frames is used to perform minimum or relative minimum luminance display or maximum or relative maximum luminance display.

Further, the method of at least one embodiment of the present invention for driving the liquid crystal display device is arranged so that an applied voltage in at least one sub-frame of the at least two sub-frames is used to perform minimum or relative minimum luminance display or maximum or relative maximum luminance display.

According to at least one embodiment of the invention, an applied voltage in at least one sub-frame of the at least two sub-frames is used to perform minimum or relative minimum luminance display or maximum or relative maximum luminance display. That is, a viewing angle of the display panel in the liquid crystal device is relatively widest in case where minimum or relative minimum luminance display (black level display) or maximum or relative maximum luminance display (white level display) is performed. Thus, two or more writing operations are performed in a single frame, and at least one writing operation of the two writing operations is performed so as to minimum or relative minimum luminance display (black level display) or maximum or relative maximum luminance display (white level display), thereby improving a viewing angle property.

Further, the liquid crystal display device of at least one embodiment of the present invention is arranged so that a voltage used to perform minimum or relative minimum luminance display or certain luminance display is applied in one sub-frame of the at least two sub-frames.

Further, the method of at least one embodiment of the present invention for driving the liquid crystal display device is arranged so that a voltage used to perform minimum or relative minimum luminance display or certain luminance display is applied in one sub-frame of the at least two sub-frames.

According to at least one embodiment of the invention, a voltage used to perform minimum or relative minimum luminance display or certain luminance display is applied in one sub-frame of the at least two sub-frames. That is, the display condition is similar to a display condition in impulse driving such as CRT which alternately displays (i) a luminance corresponding to an input signal luminance and (ii) a minimum or relative minimum luminance or a certain luminance in each frame, thereby improving a moving image display performance.

Further, the liquid crystal display device of at least one embodiment of the present invention is arranged so that: there is provided device for simultaneously applying voltages to a plurality of lines (scanning signal lines or data signal lines) in applying the voltage used to perform the minimum or relative minimum luminance display or the certain luminance display in the one sub-frame (for example, the device is operated. in accordance with the driving device recited in Tokukai 2001-60078), and a voltage obtained by partially or even fully compensating voltage drop in performing the minimum or. relative minimum luminance display or the certain luminance display is applied in performing gradation luminance display which is different from the minimum or relative minimum luminance display or the certain luminance display in the other sub-frame.

Further, the method of at least one embodiment of the present invention for driving the liquid crystal display device is arranged so that: voltages are simultaneously applied to a plurality of lines (scanning signal lines or data signal lines) in applying the voltage used to perform the minimum or relative minimum luminance display or the certain luminance display in the one sub-frame, and a voltage obtained by partially or even fully compensating voltage drop in performing the minimum or relative minimum luminance display or the certain luminance display is applied in performing gradation luminance display which is different from the minimum or relative minimum luminance display or the certain luminance display in the other sub-frame.

According to at least one embodiment of the invention, the applied voltage setting device applies voltages for minimum or relative minimum luminance display in one sub-frame of the at least two sub-frames so that voltages are applied to plural lines (scanning signal lines or data signal lines) in a single frame. In this case, voltages for minimum or relative minimum luminance display are simultaneously applied to plural pixels, so that values of the voltages are necessarily identical with each other. While, in case where an output luminance in the pixels is different in the other sub-frame, a value indicative of the voltage drop in applying the voltage for minimum or relative minimum luminance display is different. Thus, it is impossible to partially or even fully compensate the voltage drop with the voltage for minimum or relative minimum luminance display.

According to at least one embodiment of the present invention, in order to lessen or even solve such a problem, in another sub-frame which is different from the minimum or relative minimum luminance display sub-frame (in a former sub-frame of a second frame which occurs after the minimum or relative minimum luminance display sub-frame of a first frame), a panel pixel application signal voltage obtained by adding a component partially or even fully compensating the voltage drop is outputted for minimum or relative minimum luminance display, so that an average of voltages applied to liquid crystal in two frame periods becomes 0. That is, the correction based on the data conversion is not performed in the minimum or relative minimum luminance display sub-frame upon simultaneously selecting the gate lines 9, and data conversion is performed so that a pixel application voltage obtained by adding a component partially or even fully compensating the voltage drop is outputted in another sub-frame (in the former sub-frame of the second frame).

On this account, even in case where plural lines of the scanning signal lines are simultaneously scanned so as to apply a voltage for minimum or relative minimum luminance display in one sub-frame of the at least two sub-frames, it is possible to lessen or even avoid an influence of the voltage drop which is caused by a gate-drain capacitance of the thin film transistor.

Further, the liquid crystal display device of at least one embodiment of the present invention is arranged so that: the minimum or relative minimum luminance plural-output device of the second voltage generation device has a third ladder resistor circuit for receiving an image digital gradation value so as to generate a plurality of output voltages each of which corresponds to each polarity, and the third ladder resistor circuit has n number of resistors provided between a first reference voltage input tap and a next reference voltage input tap in a positive polarity and n number of resistors provided between a first reference. voltage input tap and a next reference voltage input tap in a negative polarity, and resistance values of the resistors in the positive polarity are sequentially RH(1) to RH(n) and resistance values of the resistors in the negative polarity are sequentially RL(1) to RL(n), and a relationship of the resistance values is expressed by a following. equation $$RH(k)=RL(n+1-k)$$

where n is a natural number not less than 2 and k is a natural number ranging from 1 to n.

According to at least one embodiment of the invention, the third ladder resistor circuit which functions as minimum or relative minimum luminance plural-output device for receiving an image digital gradation value so as to generate an applied voltage corresponding to each polarity has resistance values expressed by RH(k)=RL(n+1−k). As a result, also the ladder resistor circuit can output plural voltages, which each include a similar potential difference between the pixel electrode and the counter electrode or are even identical with each other in terms of the potential difference between the pixel electrode and the counter electrode, to the pixel electrode, so as to perform minimum or relative minimum luminance display.

Further, the liquid crystal display device of at least one embodiment of the present invention is arranged so that: the minimum or relative minimum luminance plural-output device has identical voltage output controlling device for causing the third ladder resistor circuit to retrieve output voltages, applied to the pixel electrode, which each include a similar potential difference between the pixel electrode and the counter electrode or are even identical with each other in terms of the potential difference between the pixel electrode and the counter electrode, and the identical voltage output controlling device performs such control that, when terminal voltages of the n number of resistors in the positive polarity are sequentially VH(0) to VH(n) and terminal voltages of the n number of resistors in the negative polarity are sequentially VL(0) to VL(n) and VH(n)−VH(0)=VL(0)−VL(n), an output voltage VH(k) is outputted in the positive polarity and an output voltage VL(n+1−k) is outputted in the negative polarity where n is a natural number not less than 2 and k is a natural number ranging from 0 to n.

According to at least one embodiment of the invention, the identical voltage output controlling device performs such control that, when VH(n)−VH(0)=VL(0)−VL(n), an output voltage VH(k) (k is a natural number ranging from 0 to n) is outputted in the positive polarity and an output voltage VL(n+1−k) is outputted in the negative polarity.

On this account, it is possible to output n+1 combinations of voltages, different from each other, in which a potential difference between the pixel electrode and the counter electrode is (VH(k)−VL(n+1−k))/2.

Further, the liquid crystal display device of at least one embodiment of the present invention is arranged so that: the maximum or relative maximum luminance plural-output device of the second voltage generation device has a fourth ladder resistor circuit for receiving an image digital gradation value so as to generate output voltages each of which corresponds to each polarity, and the fourth ladder resistor circuit has n number of resistors provided between a final reference voltage input tap and a previous reference voltage input tap in a positive polarity and n number of resistors provided between a final reference voltage input tap and a previous reference voltage input tap in a negative polarity, and resistance values of the resistors in the positive polarity are sequentially RH(max) to RH(max−n+1) and resistance values of the resistors in the negative polarity are sequentially RL(max) to RL(max−n+1), and a relationship of the resistance values is expressed by a following equation $$RH(\max+1-k)=RL(\max-n+k)$$

where n is a natural number not less than 2 and k is a natural number ranging from 1 to n.

According to at least one embodiment of the invention, the fourth ladder resistor circuit which functions as the maximum or relative maximum luminance plural-output device for receiving an image digital gradation value so as to generate an output voltage corresponding to each polarity has resistance values expressed by RH(max+1−k)=RL(max−n+k). As a result, also the ladder resistor circuit can output plural voltages, which each include a similar potential difference between the pixel electrode and the counter electrode or are even identical with each other in terms of the potential difference between the pixel electrode and the counter electrode, to the pixel electrode, so as to perform maximum or relative maximum luminance display.

Further, the liquid crystal display device of at least one embodiment of the present invention is arranged so that: the maximum or relative maximum luminance plural-output device has identical voltage output controlling device for causing the fourth ladder resistor circuit to retrieve luminance output voltages, applied to the pixel electrode, which are identical with each other in terms of the potential difference between the pixel electrode and the counter electrode, and the identical voltage output controlling device performs such control that, when terminal voltages of the n number of resistors in the positive polarity are sequentially VH(max) to VH(max−n) and terminal voltages of the n number of resistors in the negative polarity are sequentially VL(max) to VL(max−n) and VH(max)−VH(max−n)=VL(max−n)−VL(max), an output voltage VH(max−n+k) is outputted in the positive polarity and an output voltage VL(max) is outputted in the negative polarity where n is a natural number not less than 2 and max is a natural number indicative of a rank of a final resistance and k is a natural number ranging from 0 to n.

According to at least one embodiment of the invention, the identical voltage output controlling device performs such control that, when VH(max)−VH(max−n)=VL(max−n)−VL(max), an output voltage VH(max−n+k) is outputted in the positive polarity and an output voltage VL(max) is outputted in the negative polarity.

On this account, it is possible to output n+1 combinations of voltages, different from each other, in which a potential difference between the pixel electrode and the counter electrode is (VH(max−n+k)−VL(max−k))/2.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The display device of at least one embodiment of the present invention and the driving method of at least one embodiment of the present invention can be used in an active matrix liquid crystal display device. Further, the display device and the driving method can be adopted also to a liquid crystal television and a liquid crystal monitor each of which is provided with the active matrix liquid crystal display device.

The invention claimed is:

1. A liquid crystal display device for carrying out gradation display, via sub-frames of a time-divided image, to each of a plurality of pixels via a respective switching device, comprising:

an applied voltage setting device, adapted to set a voltage to be applied to each respective pixel based at least in part upon a voltage value of a previous sub-frame, so as to at least partially compensate for a capacitance induced voltage drop of each respective switching device, each frame of the time-divided image being time divided into two sub-frames, wherein the frames are constituted by repetition of a first frame and a second frame following the first frame, the applied voltage setting device being adapted to apply a voltage whose polarities are positive and negative to a data signal line of the display device so as to alternatively reverse the polarities on a basis of a counter voltage of a counter electrode in each frame so that the pixel is driven, and being adapted to set the voltage applied to the data signal line so that voltage drop in a positive polarity and voltage drop in a negative polarity are at least partially compensated, the applied voltage setting device including a look-up table for outputting conversion gradation values obtained by converting an image input gradation value into a value in a positive polarity and a value in a negative polarity so that the voltage drop in each sub-frame is at least partially compensated, the look-up table storing gradation values for each sub-frame in both the positive polarity and the negative polarity to compensate for the capacitance induced voltage drop, wherein an applied voltage in a first sub-frame, which is one of two sub-frames in each of the first and second frames, is used to perform gradation luminance display, which is different from relative minimum luminance display or minimum luminance display, wherein an applied voltage in a second sub-frame, which is the other one of the two sub-frames in each of the first and second frames, is used to perform relative minimum luminance display or minimum luminance display; and means for simultaneously applying voltages to a plurality of lines when applying the voltage used to perform the relative minimum luminance display or the minimum luminance display in the second sub-frame in the first frame, wherein correction conversion corresponding to a pull-in voltage is not carried out in the second sub-frame in each of the first and second frames in which second sub-frame the voltage used to perform the relative minimum luminance display or the minimum luminance display is applied and which the second sub-frame of the first frame is for simultaneously selecting a plurality of scanning lines, wherein a voltage obtained by at least partially compensating the voltage drop in performing the relative minimum luminance display or the minimum luminance display in the second sub-frame in the first frame is applied in performing the gradation luminance display, which is different from the relative minimum luminance display or the minimum luminance display in the first sub-frame in the second frame, wherein an average of voltages applied to liquid crystal in two frame periods including the first and second frames is 0.

2. A liquid crystal display device for carrying out gradation display, via sub-frames of a time-divided image, to each of a plurality of pixels via a respective switching device, comprising:

an applied voltage setting device, adapted to set a voltage to be applied to each respective pixel based at least in part upon a voltage value of a previous sub-frame, so as to at least partially compensate for a capacitance induced voltage drop of each respective switching device, each frame of the time-divided image being time divided into two sub-frames, wherein the frames are constituted by repetition of a first frame and a second frame following the first frame, the applied voltage setting device being adapted to apply a voltage whose polarities are positive and negative to a data signal line of the display device so as to alternatively reverse the polarities on a basis of a counter voltage of a counter electrode in each frame so that the pixel is driven, and being adapted to set the voltage applied to the data signal line so that voltage drop in a positive polarity and voltage drop in a negative polarity are at least partially compensated, the applied voltage setting device including a look-up table for outputting conversion gradation values obtained by converting an image input gradation value into a value in a positive polarity and a value in a negative polarity so that the voltage drop in each sub-frame is at least partially compensated, the look-up table storing gradation values for each sub-frame in both the positive polarity and the negative polarity to compensate for the capacitance induced voltage drop, wherein an applied voltage in a first sub-frame, which is one of two sub-frames in each of the first and second frames, is used to perform gradation luminance display, which is different from relative maximum luminance display or maximum luminance display, wherein an applied voltage in a second sub-frame, which is the other one of the two sub-frames in each of the first and second frames, is used to perform the relative maximum luminance display or the maximum luminance display; and means for simultaneously applying voltages to a plurality of lines when applying the voltage used to perform the relative maximum luminance display or the maximum luminance display in the second sub-frame the first frame, wherein correction conversion corresponding to a pull-in voltage is not carried out in the second sub-frame in each of the first and second frames in which second sub-frame the voltage used to perform the relative maximum luminance display or the maximum luminance display is applied and which the second sub-frame of the first frame is for simultaneously selecting a plurality of scanning lines, wherein a voltage obtained by at least partially compensating the voltage drop in performing the relative maximum luminance display or the maximum luminance display in the second sub-frame in the first frame is applied in performing the gradation luminance display, which is different from the relative maximum luminance display or the maximum luminance display in the first sub-frame in the second frame, wherein an average of voltages applied to liquid crystal in two frame periods including the first and second frames is 0.

3. A method for driving a liquid crystal display to carry out gradation display, via sub-frames of a time-divided image, to each of a plurality of pixels via a respective switching device, said method comprising:

setting a voltage to be applied to each respective pixel based at least in part upon a voltage value of a previous sub-frame, so as to at least partially compensate for a capacitance induced voltage drop of each respective switching device, each frame of the time-divided image being time divided into two sub-frames, wherein the frames are constituted by repetition of a first frame and a second frame following the first frame; and applying a voltage whose polarities are positive and negative to a data signal line of the display device so as to alternatively reverse the polarities on a basis of a counter voltage of a counter electrode in each frame so that the pixel is driven, wherein the voltage applied to the data signal line is set so that voltage drop in a positive polarity and voltage drop in a negative polarity are at least partially compensated, wherein a look-up table is used to output conversion gradation values obtained by converting an image input gradation value into a value in a positive polarity and a value in a negative polarity so that voltage drop in each sub-frame is at least partially compensated, the look-up table storing gradation values for each sub-frame in both the positive polarity and the negative polarity to compensate for the capacitance induced voltage drop, wherein an applied voltage in a first sub-frame, which is one of two sub-frames in each of the first and second frames, is used to perform gradation luminance display, which is different from relative minimum luminance display or minimum luminance display, wherein an applied voltage in a second sub-frame, which is the other one of the two sub-frames in each of the first and second frames, is used to perform the relative minimum luminance display, or the minimum luminance display; and simultaneously applying voltages to a plurality of lines when applying the voltage used to perform the relative minimum luminance display or the minimum luminance display in the second sub-frame in the first frame, wherein correction conversion corresponding to a pull-in voltage is not carried out in the second sub-frame in each of the first and second frames in which second sub-frame the voltage used to perform the relative minimum luminance display or the minimum luminance display is applied and which the second sub-frame of the first frame is for simultaneously selecting a plurality of scanning lines, wherein a voltage obtained by at least partially compensating the voltage drop in performing the relative minimum luminance display or the minimum luminance display in the second sub-frame in the first frame is applied in performing the gradation luminance display, which is different from the relative minimum luminance display or the minimum luminance display in the first sub-frame in the second frame, wherein an average of voltages applied to liquid crystal in two frame periods including the first and second frames is 0.

4. A method for driving a liquid crystal display to carry out gradation display, via sub-frames of a time-divided image, to each of a plurality of pixels via a respective switching device, said method comprising:

setting a voltage to be applied to each respective pixel based at least in part upon a voltage value of a previous sub-frame, so as to at least partially compensate for a capacitance induced voltage drop of each respective switching device, each frame of the time-divided image being time divided into two sub-frames, wherein the frames are constituted by repetition of a first frame and a second frame following the first frame; and applying a voltage whose polarities are positive and negative to a data signal line of the display device so as to alternatively reverse the polarities on a basis of a counter voltage of a counter electrode in each frame so that the pixel is driven, wherein the voltage applied to the data signal line is set so that voltage drop in a positive polarity and voltage drop in a negative polarity are at least partially compensated, wherein a look-up table is used to output conversion gradation values obtained by converting an image input gradation value into a value in a positive polarity and a value in a negative polarity so that voltage drop in each sub-frame is at least partially compensated, the look-up table storing gradation values for each sub-frame in both the positive polarity and the negative polarity to compensate for the capacitance induced voltage drop, wherein an applied voltage in a first sub-frame, which is one of two sub-frames in each of the first and second frames, is used to perform gradation luminance display, which is different from relative maximum luminance display or maximum luminance display, wherein an applied voltage in a second sub-frame, which is the other one of the two sub-frames in each of the first and second frames, is used to perform the relative maximum luminance display or the maximum luminance display; and simultaneously applying voltages to a plurality of lines when applying the voltage used to perform the relative maximum luminance display or the maximum luminance display in the second sub-frame in the first frame, wherein correction conversion corresponding to a pull-in voltage is not carried out in the second sub-frame in each of the first and second frames in which second sub-frame the voltage used to perform the relative maximum luminance display or the maximum luminance display is applied and which the second sub-frame of the first frame is for simultaneously selecting a plurality of scanning lines, wherein a voltage obtained by at least partially compensating the voltage drop in performing the relative maximum luminance display or the maximum luminance display in the second sub-frame in the first frame is applied in performing the gradation luminance display, which is different from the relative maximum luminance display or the maximum luminance display in the first sub-frame in the second frame, wherein an average of voltages applied to liquid crystal in two frame periods including the first and second frames is 0.

5. A liquid crystal television, comprising:

a liquid crystal display device as claimed in claim 1; and a tuner section, serving as a video signal source of the liquid crystal display device, which selects a channel of a television broadcasting signal and outputs a television video signal of the channel, that has been selected, as a display signal.

6. A liquid crystal monitor, comprising:

a liquid crystal display device as claimed in claim 1; and a monitor signal processing section, serving as a video signal source of the liquid crystal display device, which processes a monitor signal that should be displayed in the liquid crystal display device and outputs the monitor signal, that has been processed, as a video signal.

7. A liquid crystal television, comprising: a liquid crystal display device as claimed in claim 2; and a tuner section, serving as a video signal source of the liquid crystal display device, which selects a channel of a television broadcasting signal and outputs a television video signal of the channel, that has been selected, as a display signal.

8. A liquid crystal monitor, comprising: a liquid crystal display device as claimed in claim 2; and a monitor signal processing section, serving as a video signal source of the liquid crystal display device, which processes a monitor signal that should be displayed in the liquid crystal display device and outputs the monitor signal, that has been processed, as a video signal.

* * * * *